US011769948B2

(12) United States Patent
Sarabandi et al.

(10) Patent No.: US 11,769,948 B2
(45) Date of Patent: Sep. 26, 2023

(54) DUAL-BAND DUAL-POLARIZED ANTENNA FOR 5G APPLICATIONS

(71) Applicant: THE REGENTS OF THE UNIVERSITY OF MICHIGAN, Ann Arbor, MI (US)

(72) Inventors: Kamal Sarabandi, Ann Arbor, MI (US); Menglou Rao, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 38 days.

(21) Appl. No.: 17/320,784

(22) Filed: May 14, 2021

(65) Prior Publication Data

US 2021/0359413 A1 Nov. 18, 2021

Related U.S. Application Data

(60) Provisional application No. 63/026,000, filed on May 16, 2020.

(51) Int. Cl.
*H01Q 21/06* (2006.01)
*H01Q 5/385* (2015.01)
*H01Q 9/04* (2006.01)

(52) U.S. Cl.
CPC ..... *H01Q 5/385* (2015.01); *H01Q 9/0414* (2013.01); *H01Q 21/062* (2013.01); *H01Q 21/065* (2013.01)

(58) Field of Classification Search
CPC .... H01Q 5/385; H01Q 9/0414; H01Q 21/062; H01Q 21/065
See application file for complete search history.

(56) References Cited

U.S. PATENT DOCUMENTS 4,095,227 A * 6/1978 Kaloi ..... H01Q 9/0421 343/700 MS
5,245,745 A * 9/1993 Jensen ..... H01Q 9/0442 343/700 MS (Continued)

FOREIGN PATENT DOCUMENTS

CN 109004337 B 10/2019
WO WO-2019133195 A1 7/2019

OTHER PUBLICATIONS

B. Sadhu et al., "A 28GHz 32-element phased-array transceiver IC with concurrent dual polarized beams and 1.4 degree beam-steering resolution for 5G communication," in *Digest of Technical Papers—IEEE International Solid-State Circuits Conference*, 2017, vol. 60, pp. 128-129.

(Continued)

*Primary Examiner* — Dieu Hien T Duong
(74) *Attorney, Agent, or Firm* — Harness, Dickey & Pierce, P.L.C.

(57) ABSTRACT

A dual-polarized antenna is presented for 5G mobile communications. The antenna includes two discrete elements—a folded dipole and a folded monopole, which generate two orthogonal polarizations. Parasitic elements are used to realize higher-band operation. In one example, the antenna covers both the 28 GHz band and the 39 GHz band. The entire structure is designed on an ultra-thin four-layer laminate and is intended to be incorporated along the edges of smartphones to enable 5G operation.

18 Claims, 28 Drawing Sheets

(56) References Cited

U.S. PATENT DOCUMENTS

| | | | | |
|---|---|---|---|---|
| 2006/0139215 | A1* | 6/2006 | Heiniger | H01Q 9/0407 343/700 MS |
| 2016/0087348 | A1* | 3/2016 | Ko | H01Q 21/205 455/73 |
| 2018/0167130 | A1 | 6/2018 | Vannucci | |
| 2019/0229413 | A1* | 7/2019 | Jong | H01Q 1/243 |
| 2019/0363453 | A1* | 11/2019 | Yu | H04B 7/0413 |

OTHER PUBLICATIONS

M. M. M. Ali and A. Sebak, "Design of compact millimeter wave massive MIMO dual-band (28/38 GHz) antenna array for future 5G communication systems," 2016 17th International Symposium on Antenna Technology and Applied Electromagnetics (ANTEM), 2016, pp. 1-2, doi: 10.1109/ANTEM.2016.7550213.

M. Rao and K. Sarabandi, "A compact wideband dual-polarized millimeter wave antenna for 5G smartphones," in 2019 IEEE International Symposium on Antennas and Propagation and USNC-URSI Radio Science Meeting, APSURSI 2019—Proceedings, 2019, pp. 697-698.

* cited by examiner

| Name | Theta | Ang | Mag |
|---|---|---|---|
| m1 | 44.0000 | 44.0000 | 1.6354 |
| m2 | 30.0000 | 30.0000 | 5.1419 |

DUAL-BAND DUAL-POLARIZED ANTENNA FOR 5G APPLICATIONS

CROSS-REFERENCE TO RELATED APPLICATIONS

This application claims the benefit of U.S. Provisional Application No. 63/026,000, filed on May 16, 2020. The entire disclosure of the above application is incorporated herein by reference.

FIELD

The present disclosure relates to dual-band dual polarized antenna for cell phones and other handheld devices.

BACKGROUND 5G has been evolving at lightening speeds since the Federal Communication Committee (FCC) announced opening up 11 GHz of spectrum above 24 GHz in June, 2016. Many nations, including the US, European Union, China and South Korea, have incorporated trials of early 5G networks and established regional 5G service. Along with the enormous potential, the development of mmWave-based mobile network faces unprecedented challenges. In comparison to the sub-6 GHz frequencies, signal attenuation and path loss become more sever at mmWave frequencies.

Antenna implementation on smartphones is even more demanding since it usually requires full spatial coverage and polarization diversity. Generating vertically-polarized radiation is a major challenge in 5G smartphone antenna design due to the use of ultra-thin substrates (typically less than 1 mm) in consumer electronics. Furthermore, design trends for larger metallic displays and thinner phone cases further limit the available real estate for antennas. Significant efforts have been devoted to the development of high-gain, vertically-polarized mmWave antennas. However, these antennas only operate in a single band and have very limited bandwidth.

This section provides background information related to the present disclosure which is not necessarily prior art.

SUMMARY

This section provides a general summary of the disclosure, and is not a comprehensive disclosure of its full scope or all of its features.

In one aspect, a wideband dual-polarized antenna is presented. The antenna is comprised of a folded dipole antenna element and a folded monopole antenna element. The folded dipole antenna element is configured to receive and radiate horizontally polarized waves in a frequency band; whereas, the folded monopole antenna element is configured to receive and radiate vertically polarized waves in the frequency band. The folded dipole antenna element and the folded monopole antenna element are monolithically integrated onto the substrate.

In one embodiment, the folded monopole antenna element is shape of a rectangle with opposing folded corners. The folded monopole antenna element further includes at least one feed pin electrically coupled along an edge of the planar conductor and a plurality of shorting pins electrically coupled between the planar conductor and the ground plane, where the plurality of shorting pins are spatially separated by $\lambda/2$ from the at least one feed pin.

In one embodiment, the lower bound of the frequency band is greater than 24 Ghz.

In another aspect, a dual-band dual-polarized antenna is presented. The antenna is comprised of a dipole antenna element, a folded dipole antenna element, a low-band folded monopole antenna, and a high-band folded monopole antenna element. The dipole antenna element is configured to receive and radiate horizontally polarized waves in a first frequency band; whereas, the folded dipole antenna element is configured to receive and radiate horizontally polarized waves in a second frequency band, where lower bound of the second frequency band is higher than upper bound of the first frequency band. Similarly, the low-band folded monopole antenna element is configured to receive and radiate vertically polarized waves in the first frequency band; whereas, the high-band folded monopole antenna element is configured to receive and radiate vertically polarized waves in the second frequency band. The dipole antenna element, the folded dipole antenna element, the low-band folded monopole antenna element and the high-band folded monopole antenna element are monolithically integrated onto the substrate.

In one embodiment, the lower bound of the first frequency band is greater than 24 GHz. For example, the first frequency band is 24-30 GHz and the second frequency band is 37-43 GHz.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 4:
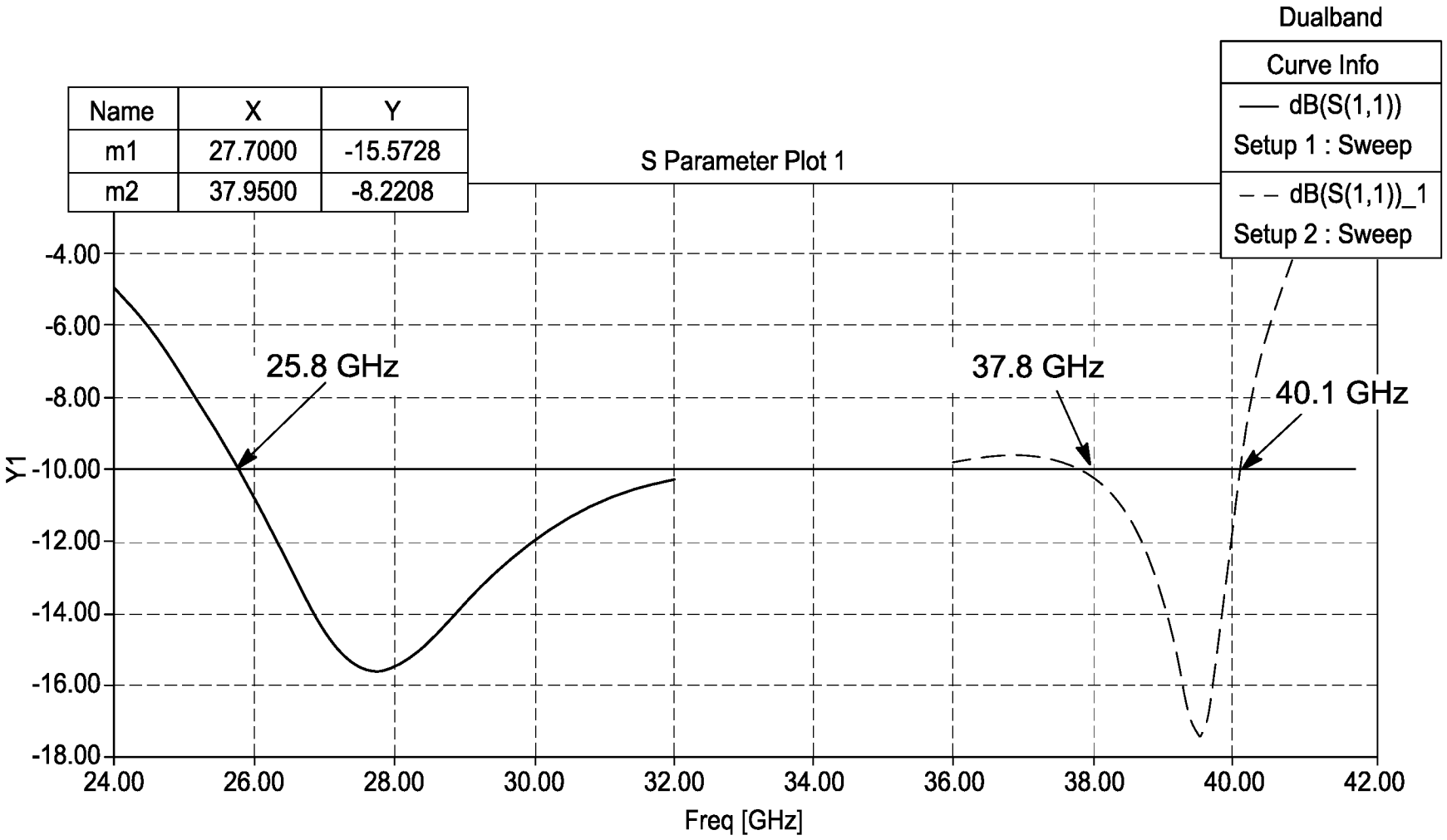

FIG. 4 plot of the S-parameter for the horizontally polarized wideband antenna elements.

Figure 5A:
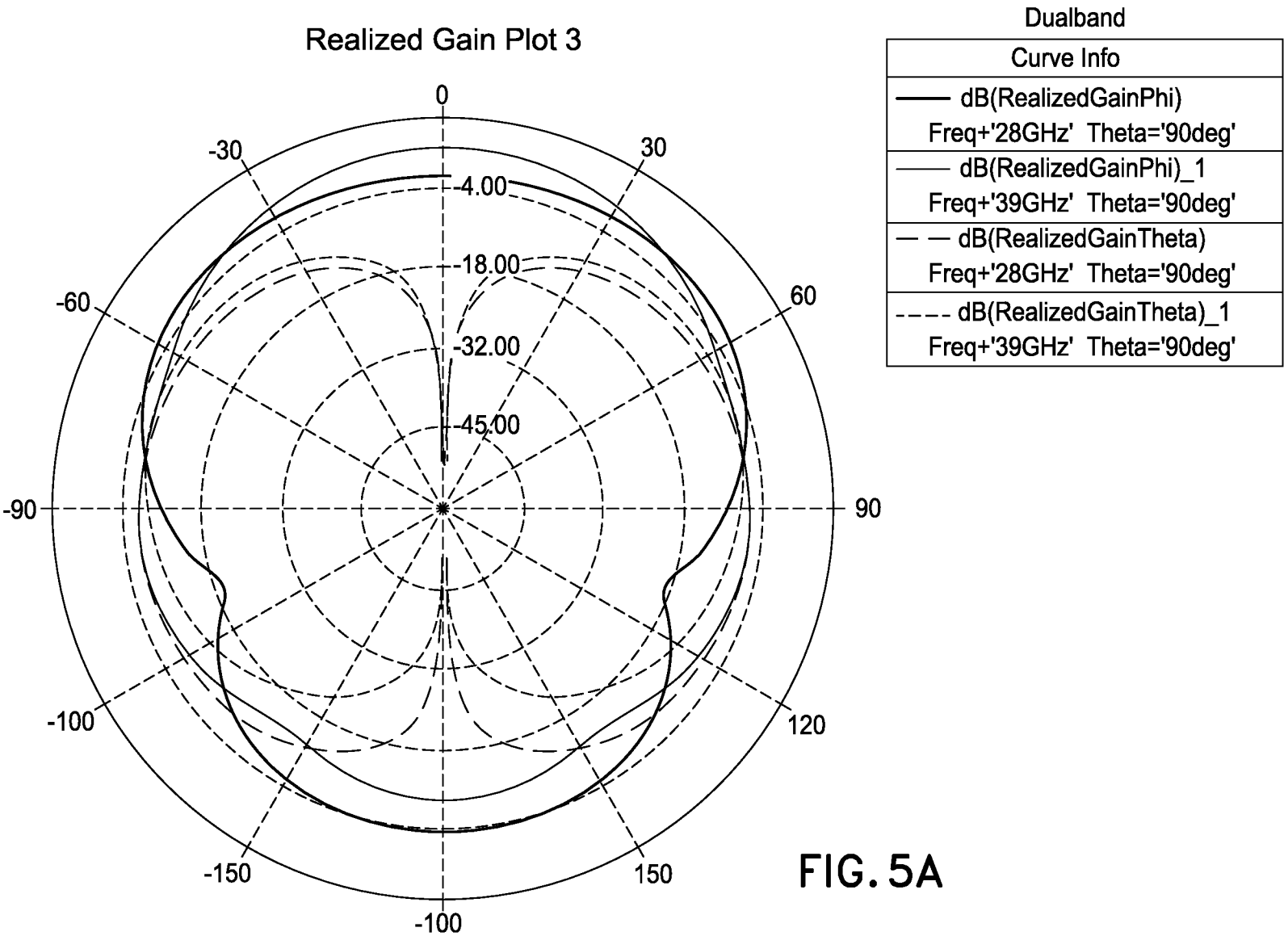
Figure 5B:
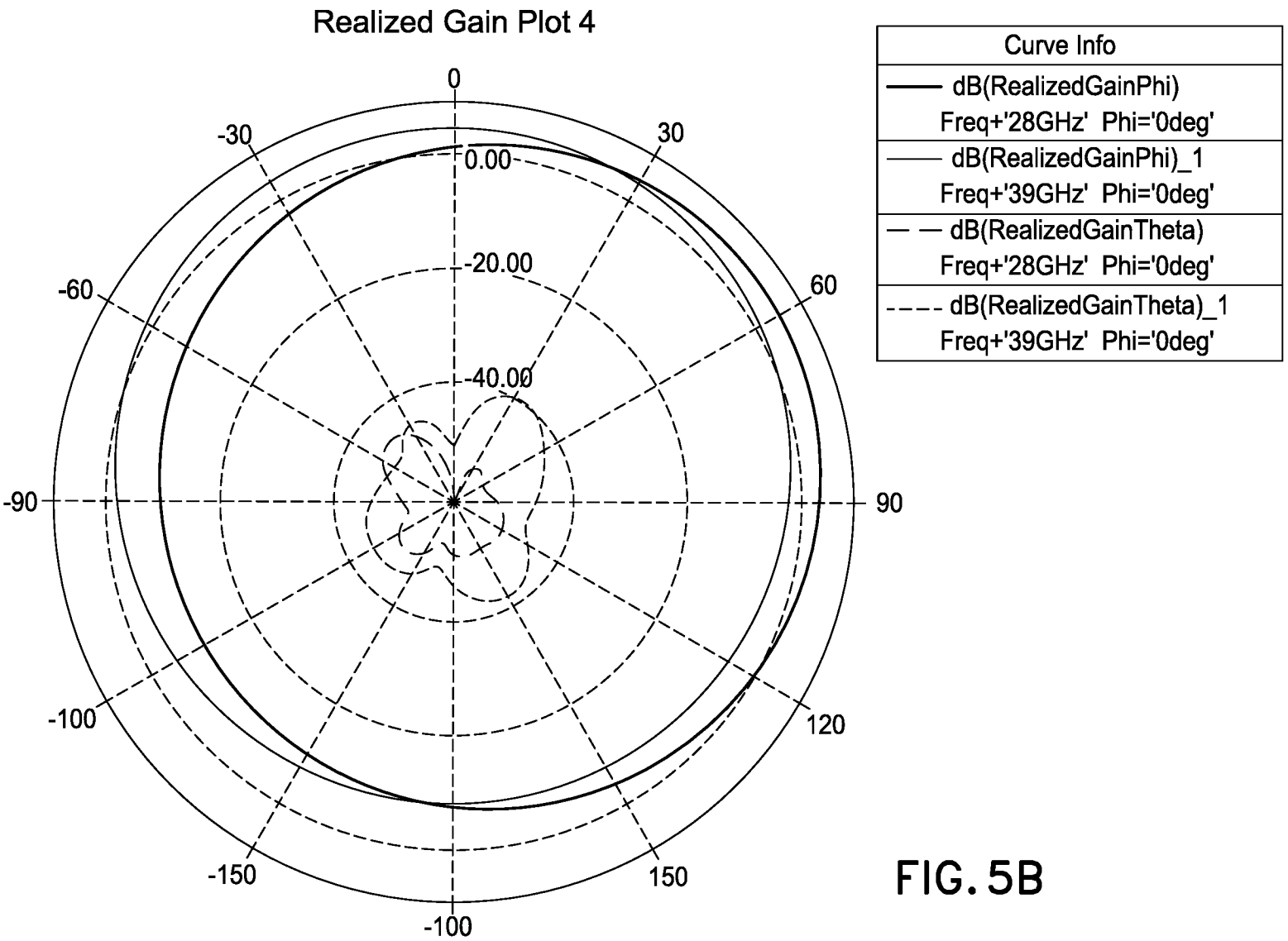

FIGS. 5A and 5B are plots of the horizontal polarization pattern for the horizontally polarized wideband antenna elements in the x-y plane at 28 GHz and 39 GHz, respectively.

Figure 6A:
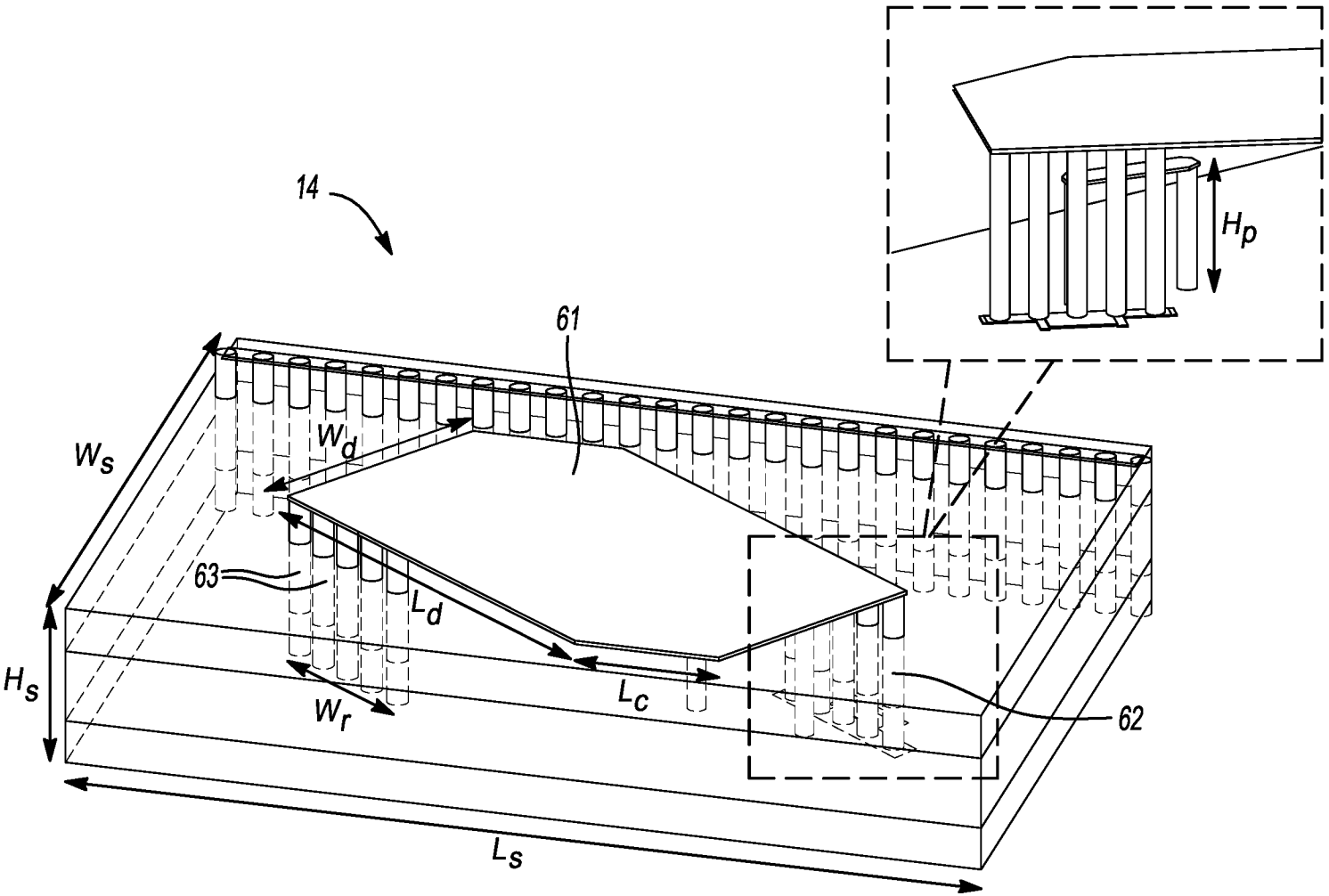

FIG. 6A is a perspective view of an antenna element in the array of vertically polarized wideband antenna elements.

Figure 6B:
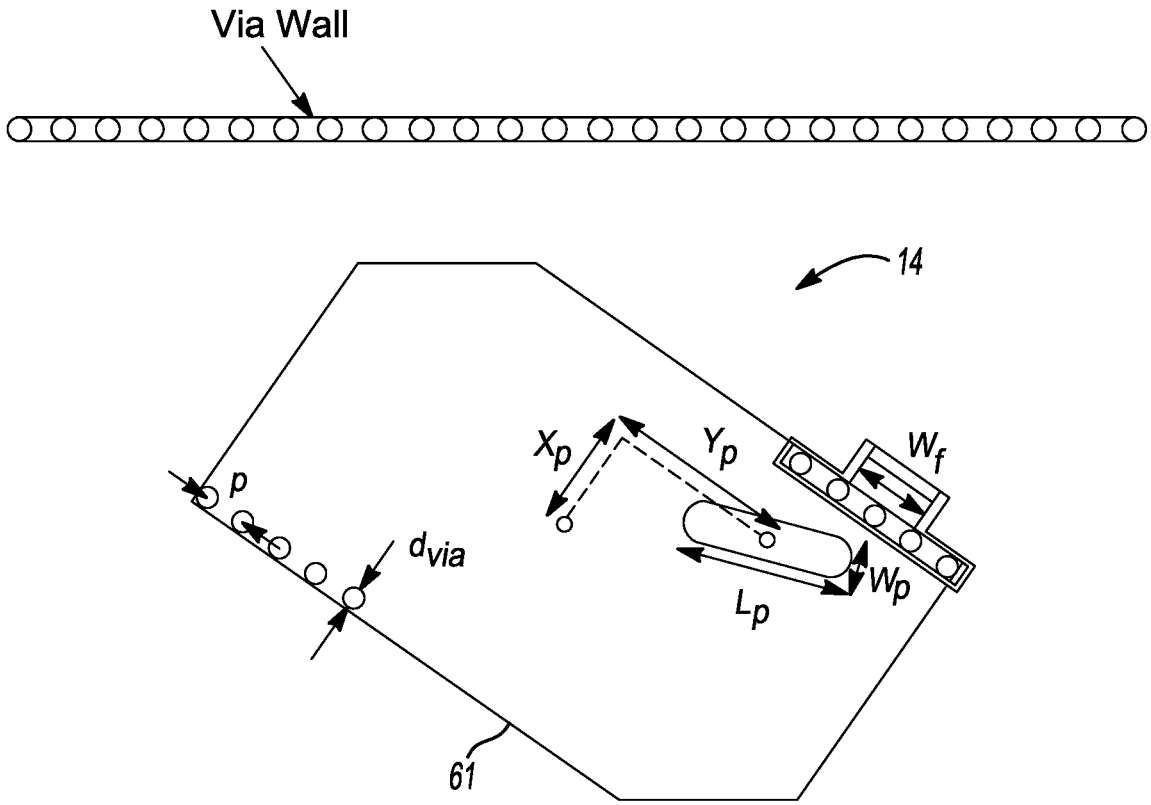

FIG. 6B is a top view of an antenna element in the array of vertically polarized wideband antenna elements.

Figure 7:
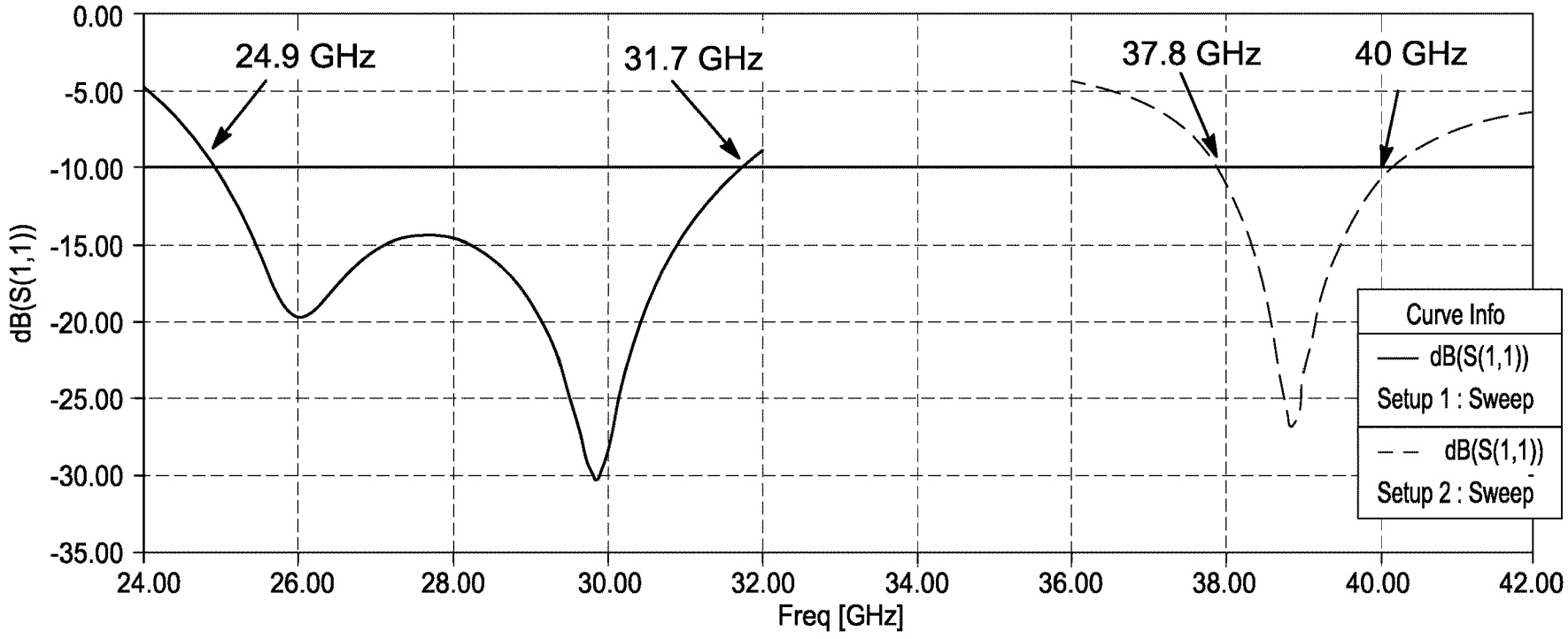

FIG. 7 plot of the S-parameter for the vertically polarized wideband antenna element.

Figure 8A:
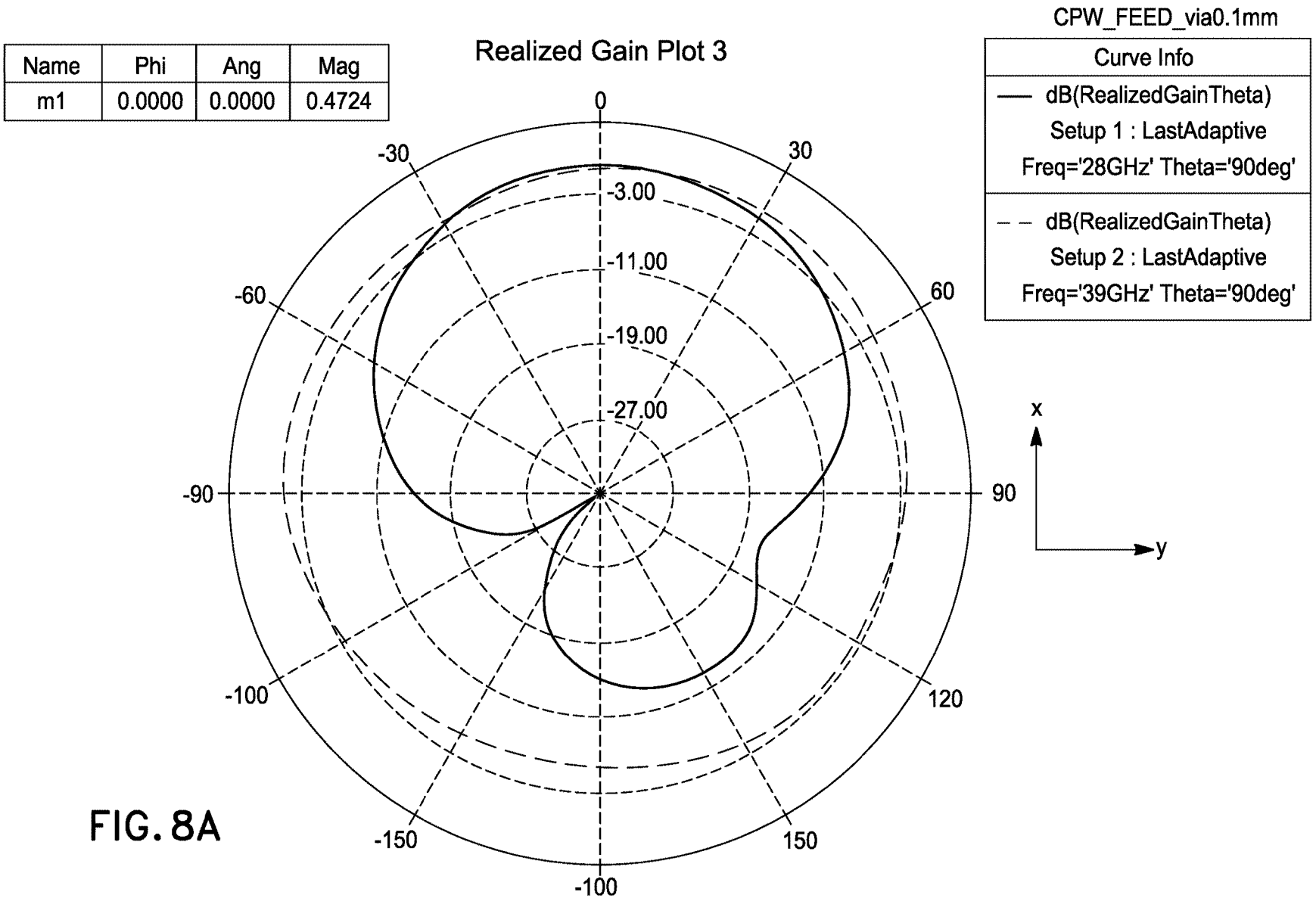
Figure 8B:
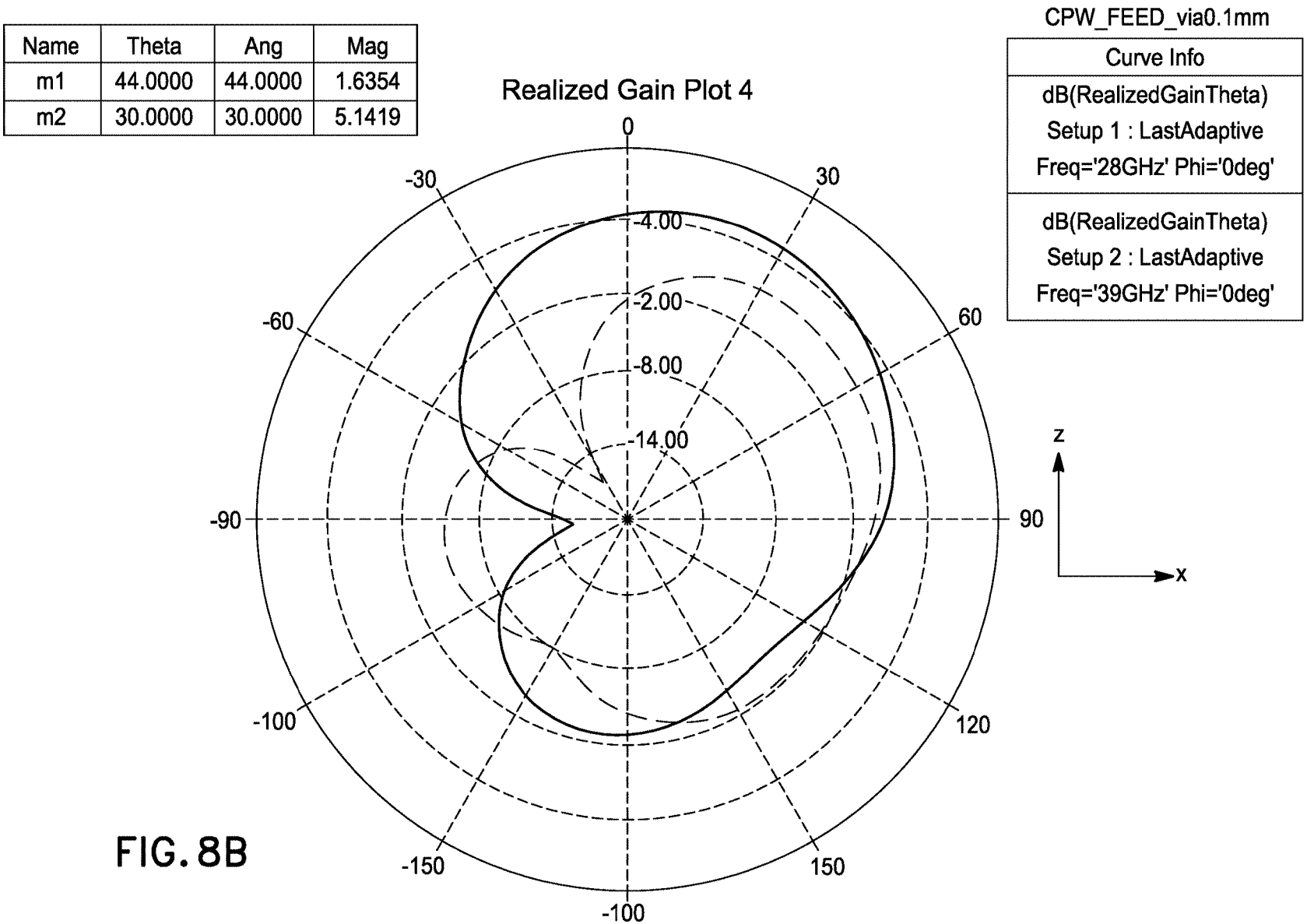

FIGS. 8A and 8B are plots of the radiation pattern for the vertically polarized wideband antenna elements at 28 GHz and 39 GHz, respectively.

Figure 9:
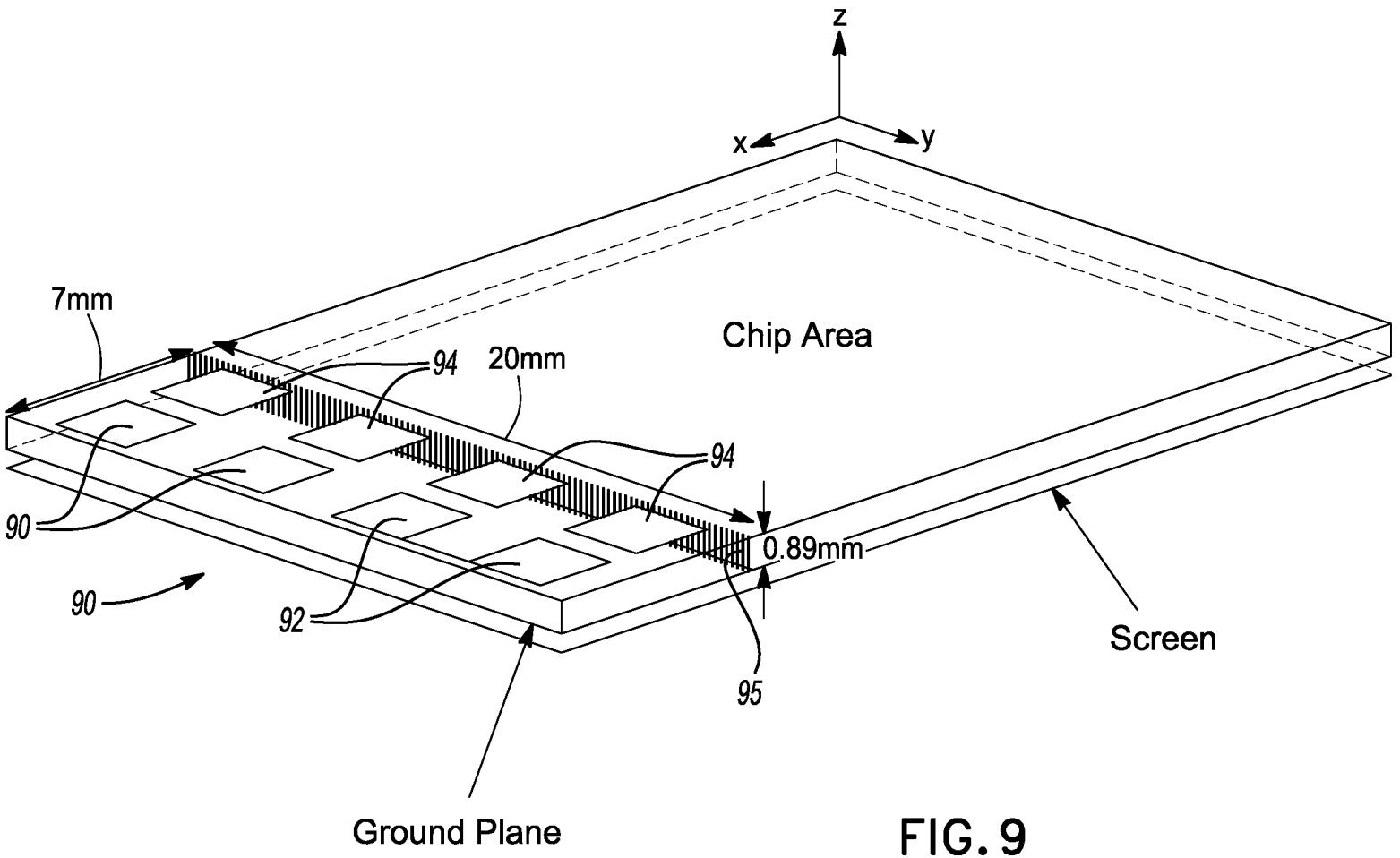

FIG. 9 is perspective view of an example embodiment of a dual-band dual-polarized wideband antenna.

Figure 10A:
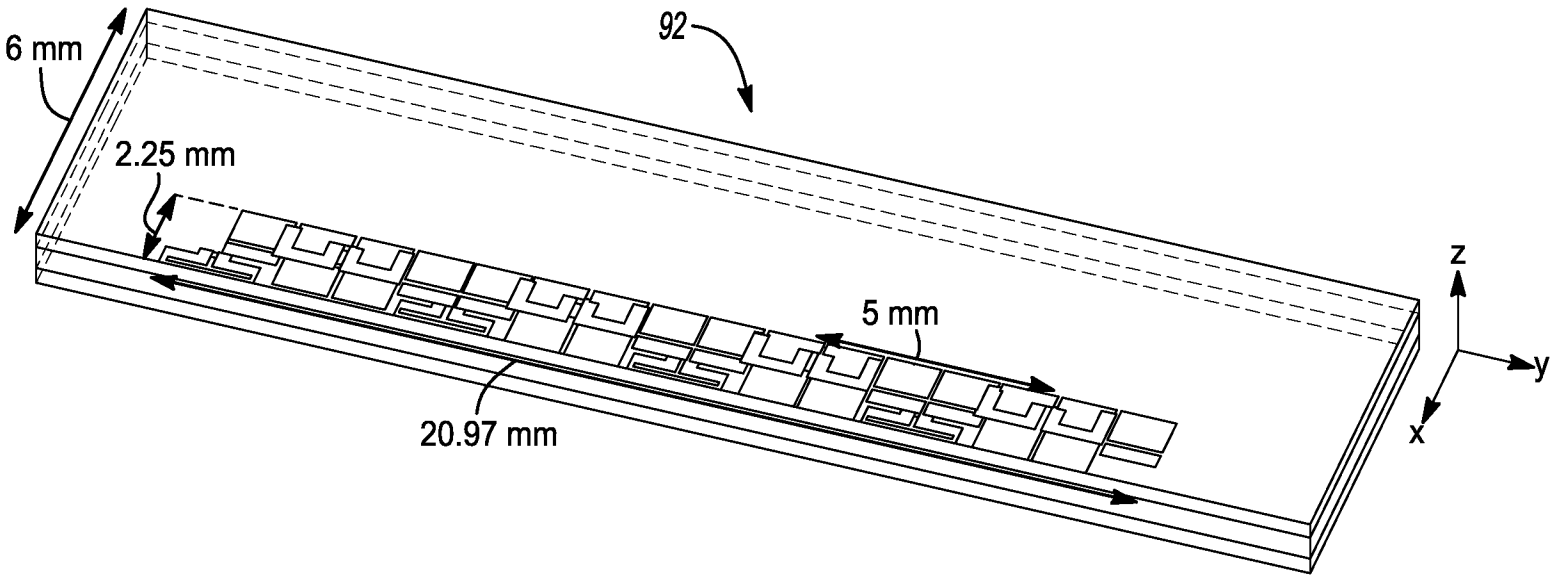

FIG. 10A is a perspective view of the array of horizontally-polarized dual-band antenna elements.

Figure 10B:
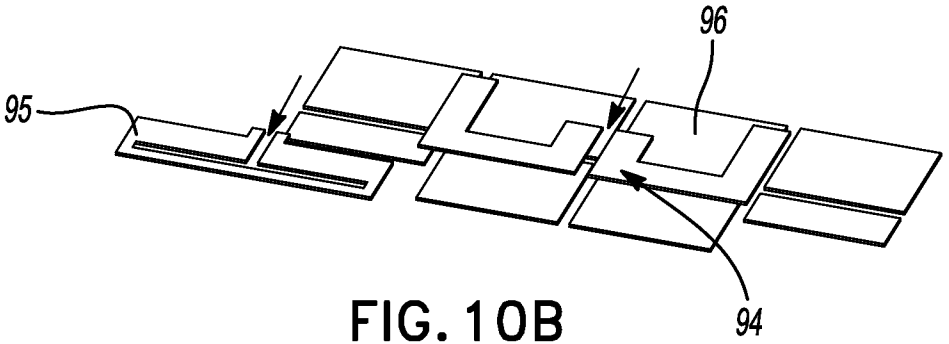

FIG. 10B is a perspective view of a single horizontally-polarized dual-band antenna element.

Figure 11:
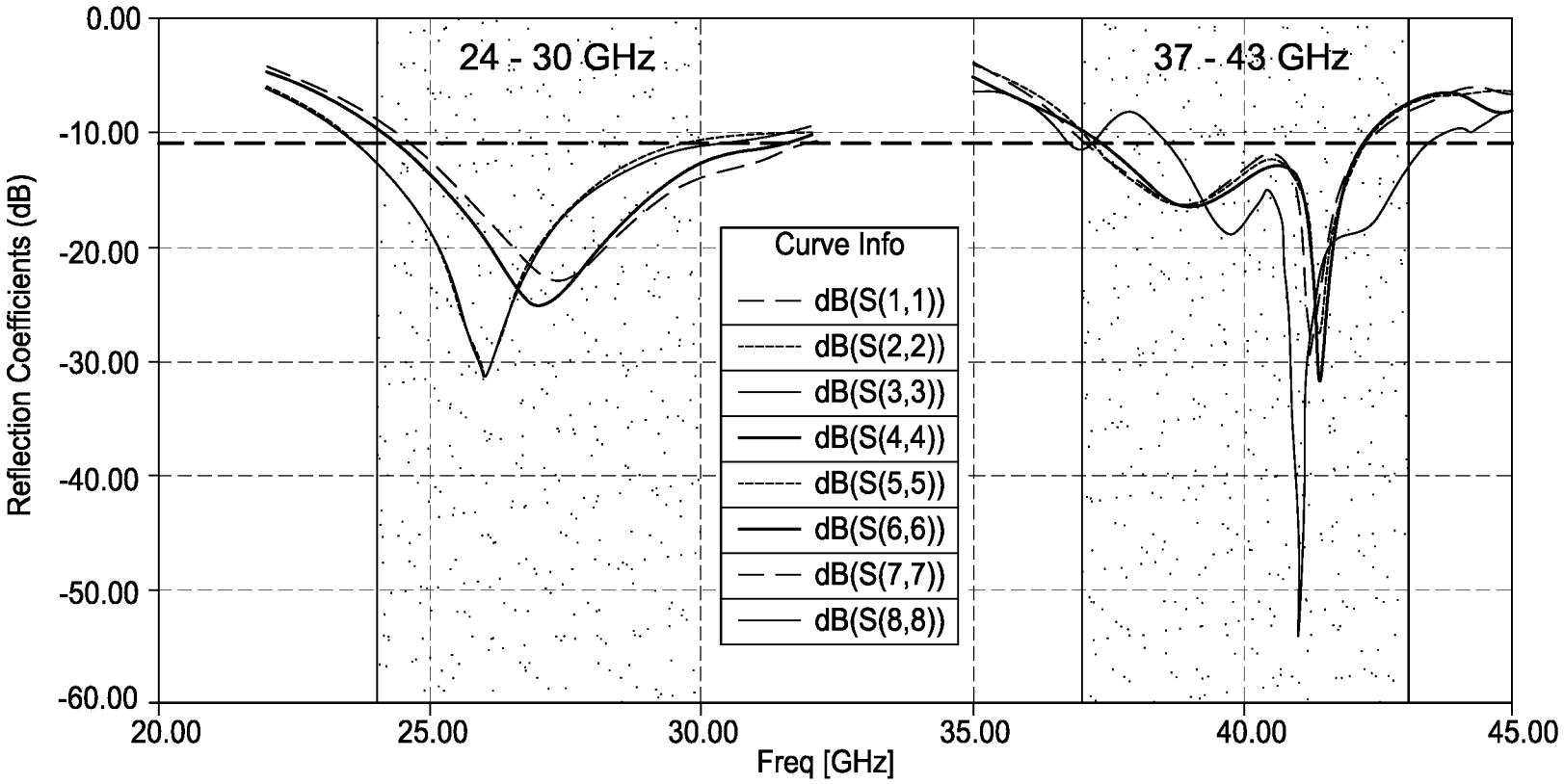

FIG. 11 is a plot of the S-parameter for the horizontally-polarized dual-band antenna elements.

Figure 12A:
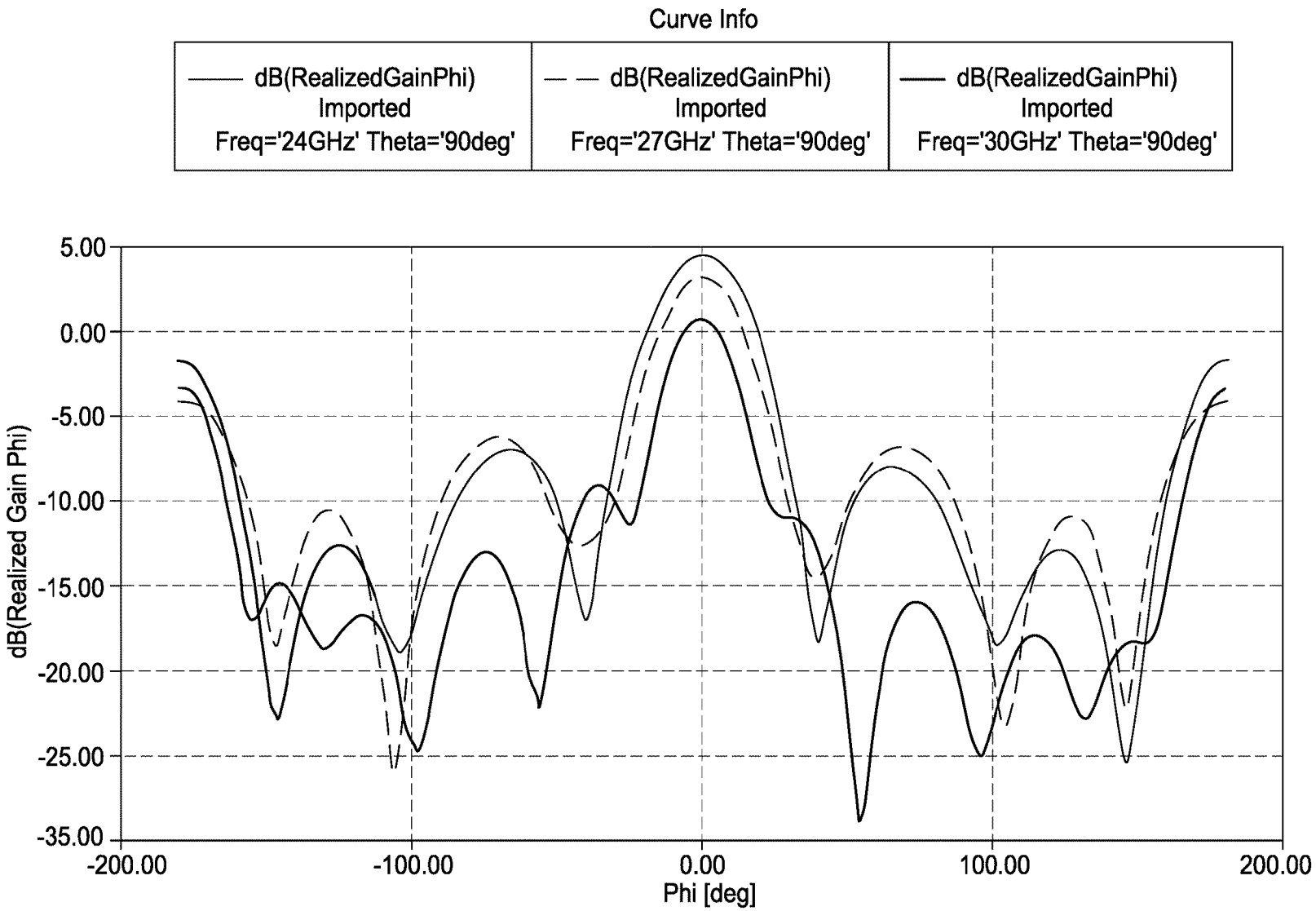
Figure 12B:
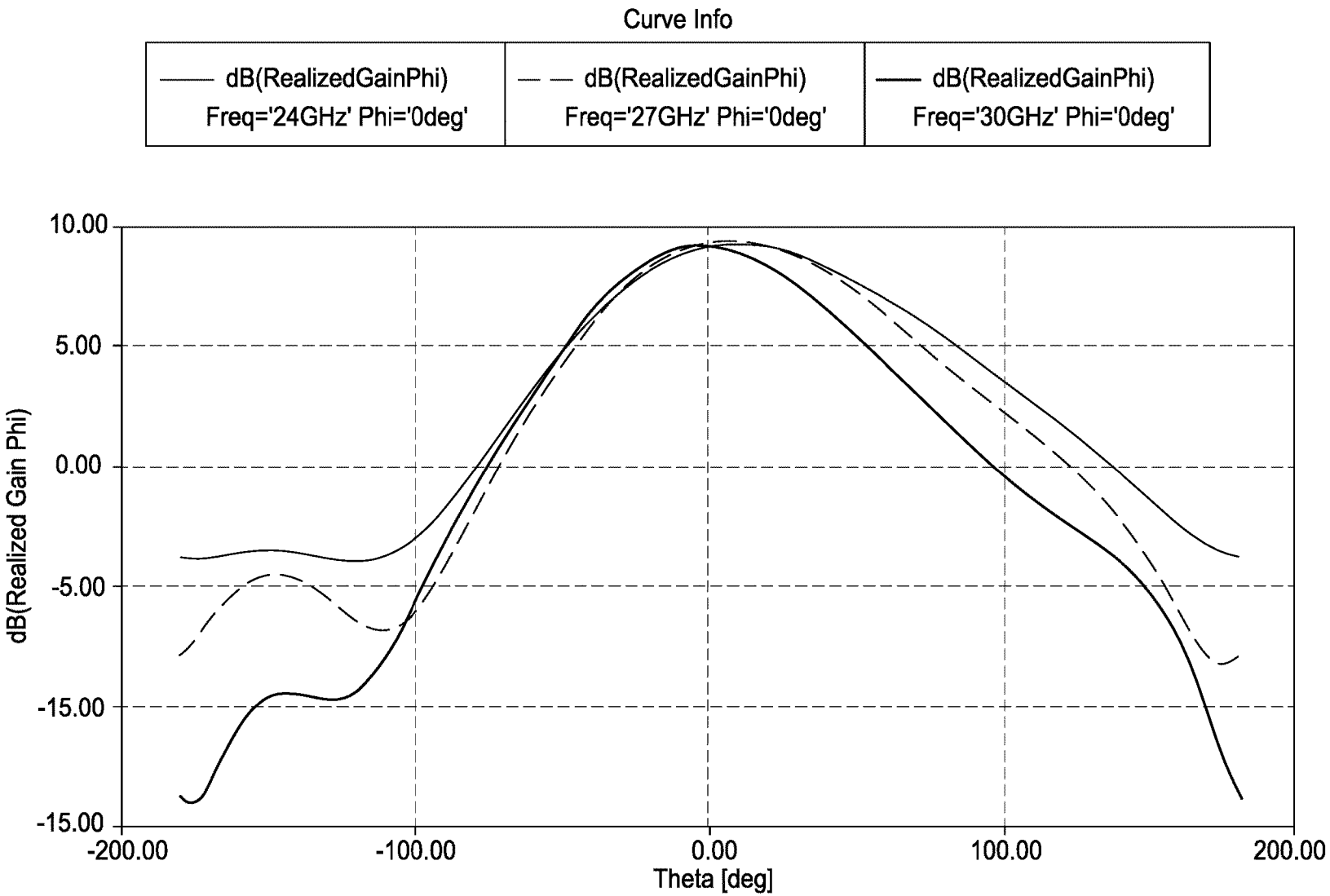

FIGS. 12A and 12B are radiation patterns for the low-band (24 Ghz-30 Ghz) horizontally-polarized dual-band antenna elements in the xy-plane and the xz-plane, respectively.

Figure 13A:
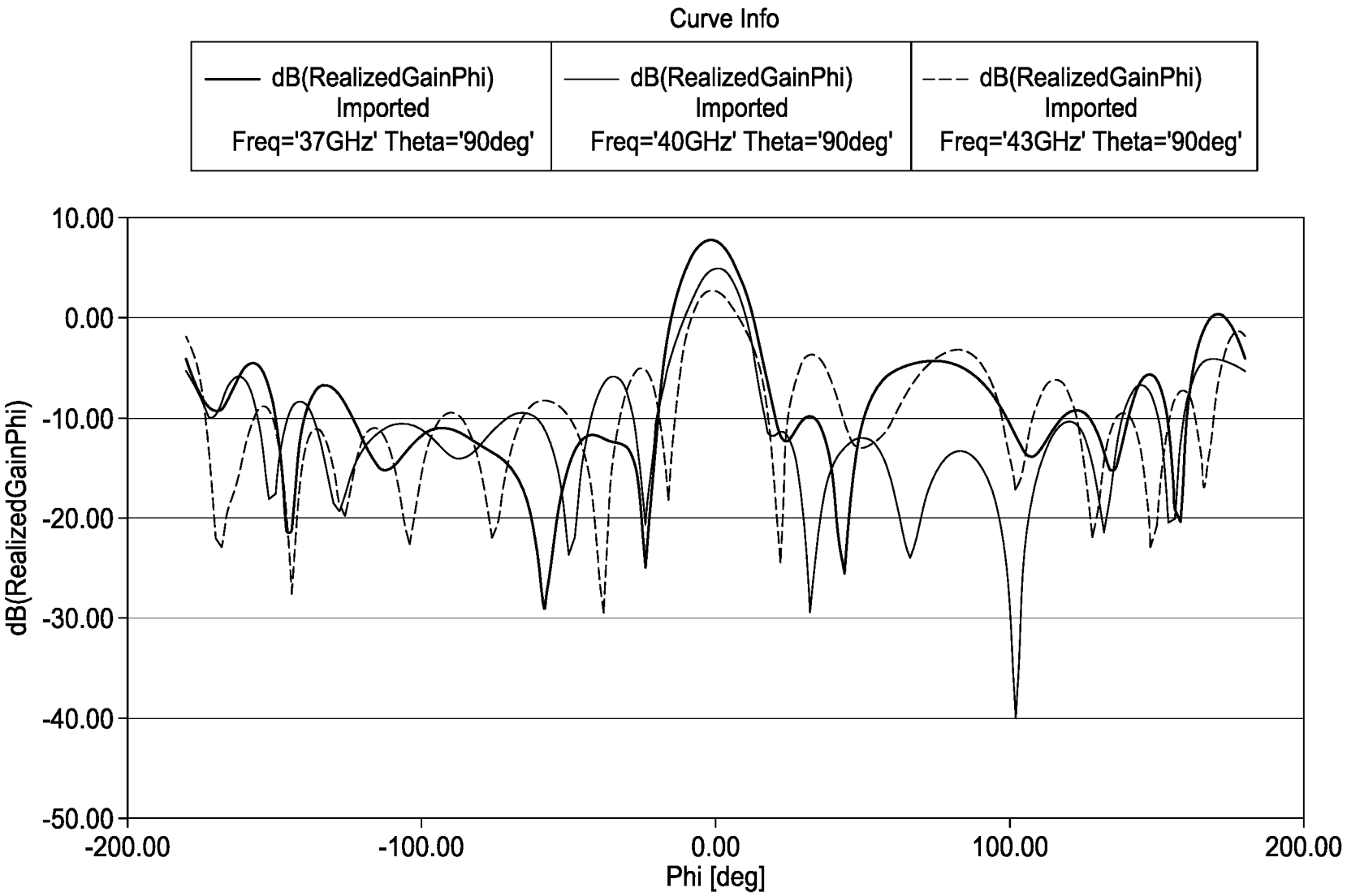
Figure 13B:
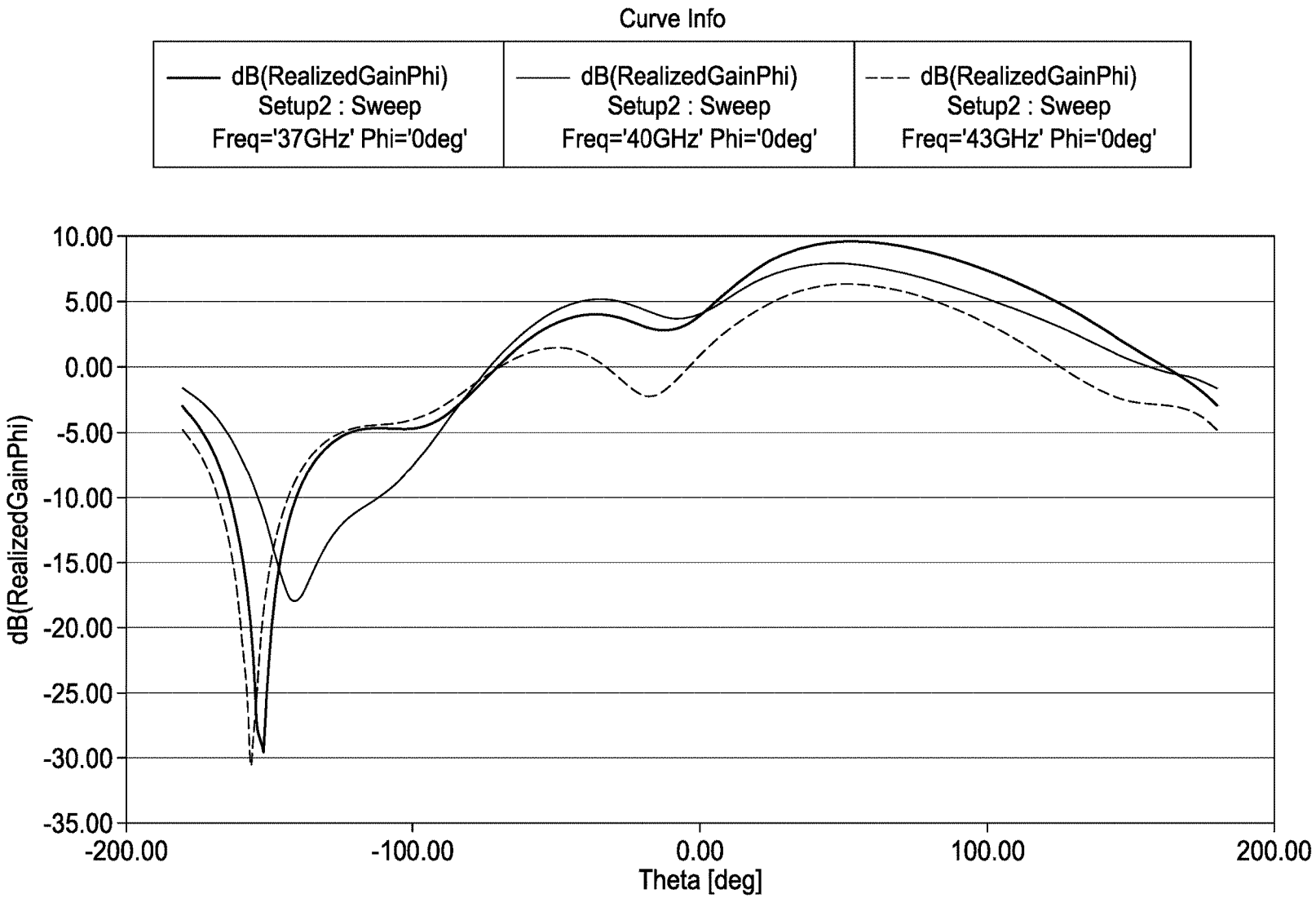

FIGS. 13A and 13B are radiation patterns for the low-band (37 Ghz-43 Ghz) horizontally-polarized dual-band antenna elements in the xy-plane and the xz-plane, respectively.

Figure 14:
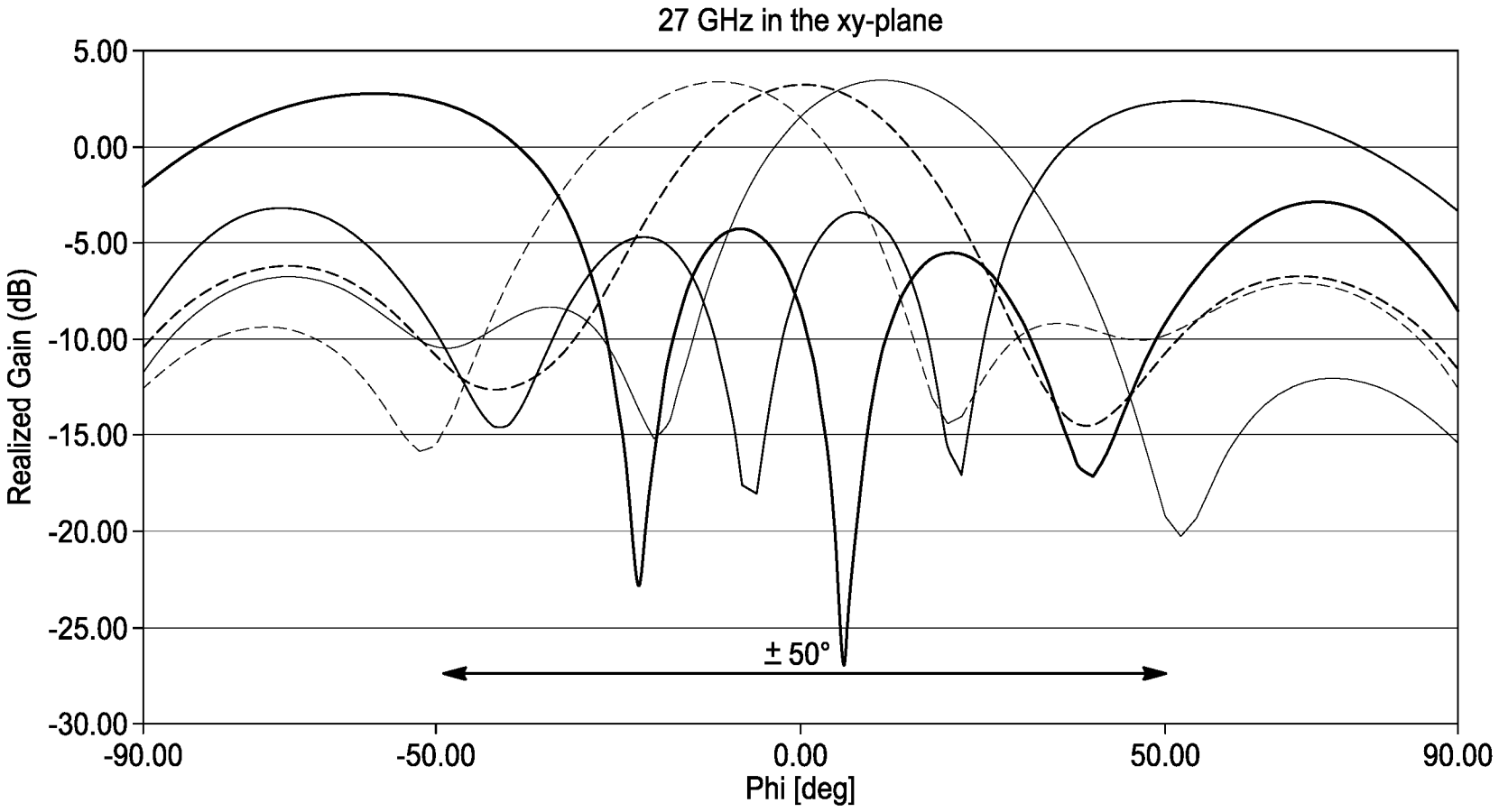

FIG. 14 is beam-steered radiation pattern for low-band horizontally-polarized dual-band antenna elements in the xy-plane.

Figure 15:
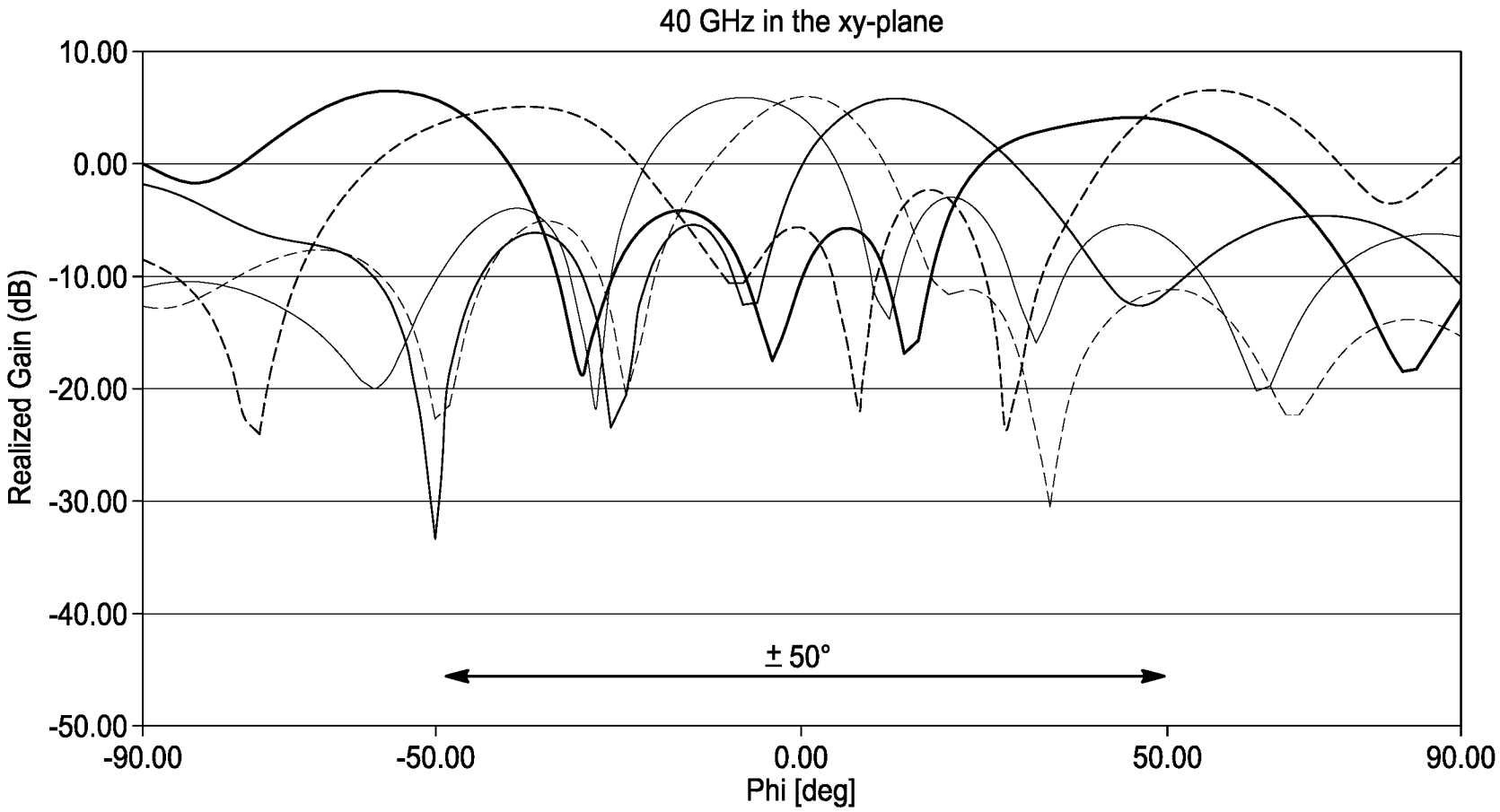

FIG. 15 is beam-steered radiation pattern for high-band horizontally-polarized dual-band antenna element in the xy-plane.

Figure 16:
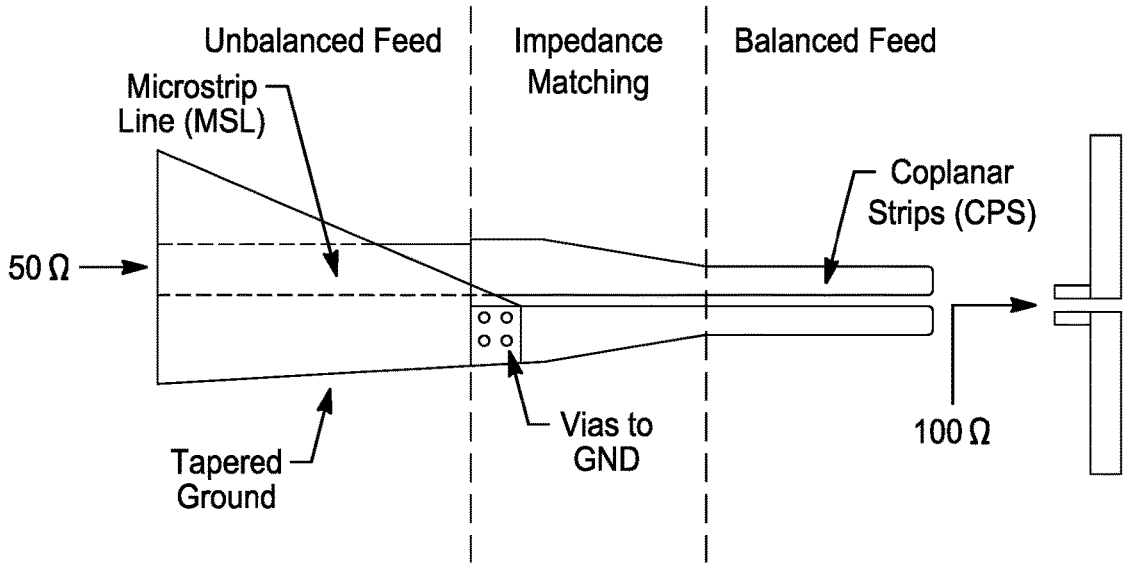

FIG. 16 illustrates a built-in balun to connect a microstrip line and match it to a coplanar strip transmission line needed to feed the horizontally-polarized antenna elements.

Figure 17:
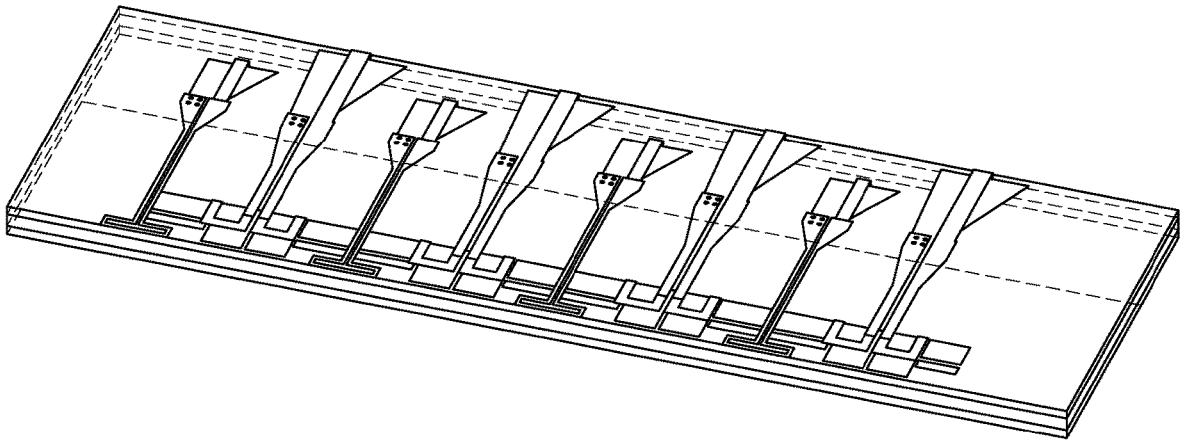

FIG. 17 is a perspective view of an example embodiment of the array of horizontally-polarized dual-band antennas integrated with the baluns.

Figure 18:
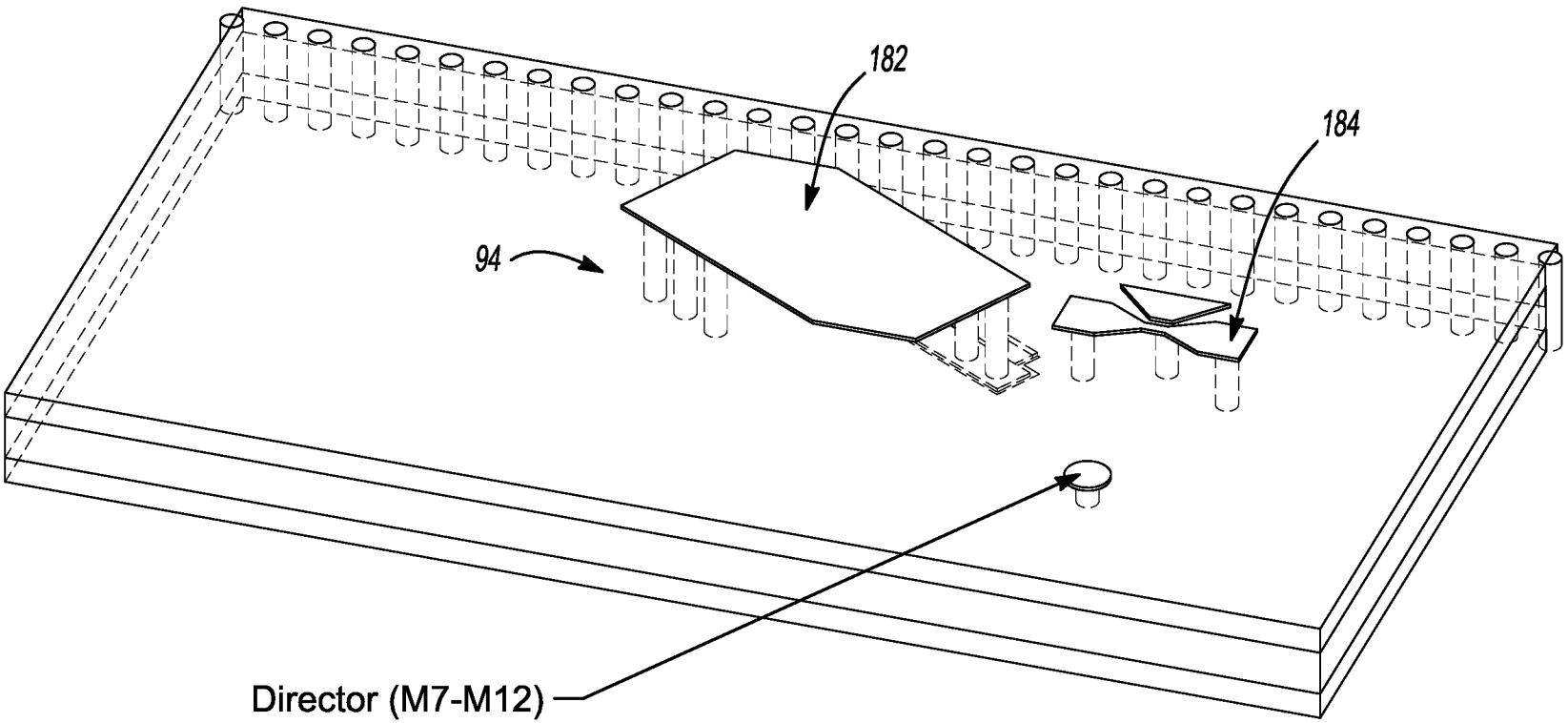

FIG. 18 is a perspective view of an example embodiment for the array of vertically-polarized dual-band antenna elements.

Figure 19:
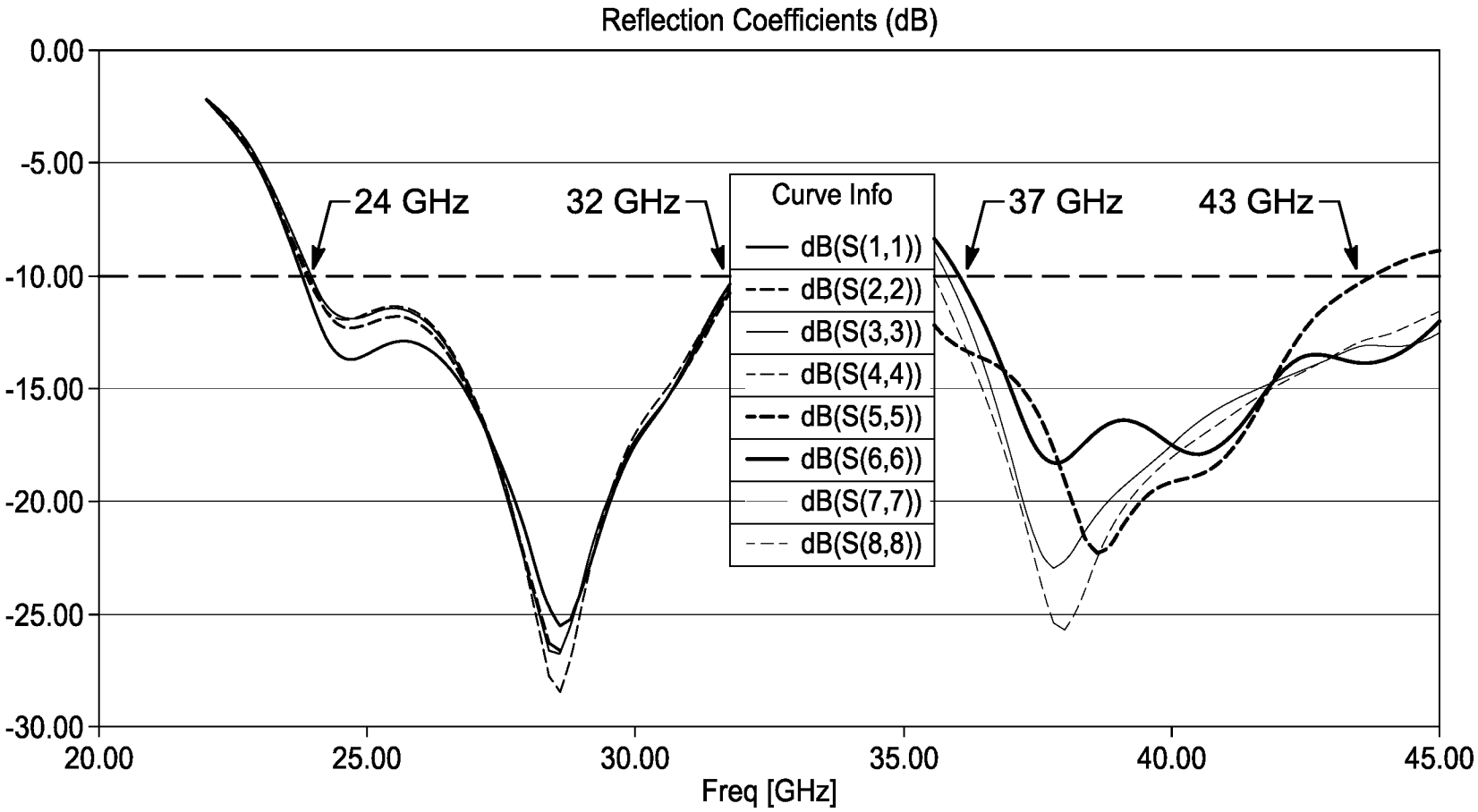

FIG. 19 is a plot of the S-parameter for the vertically-polarized dual-band antenna elements.

Figure 20A:
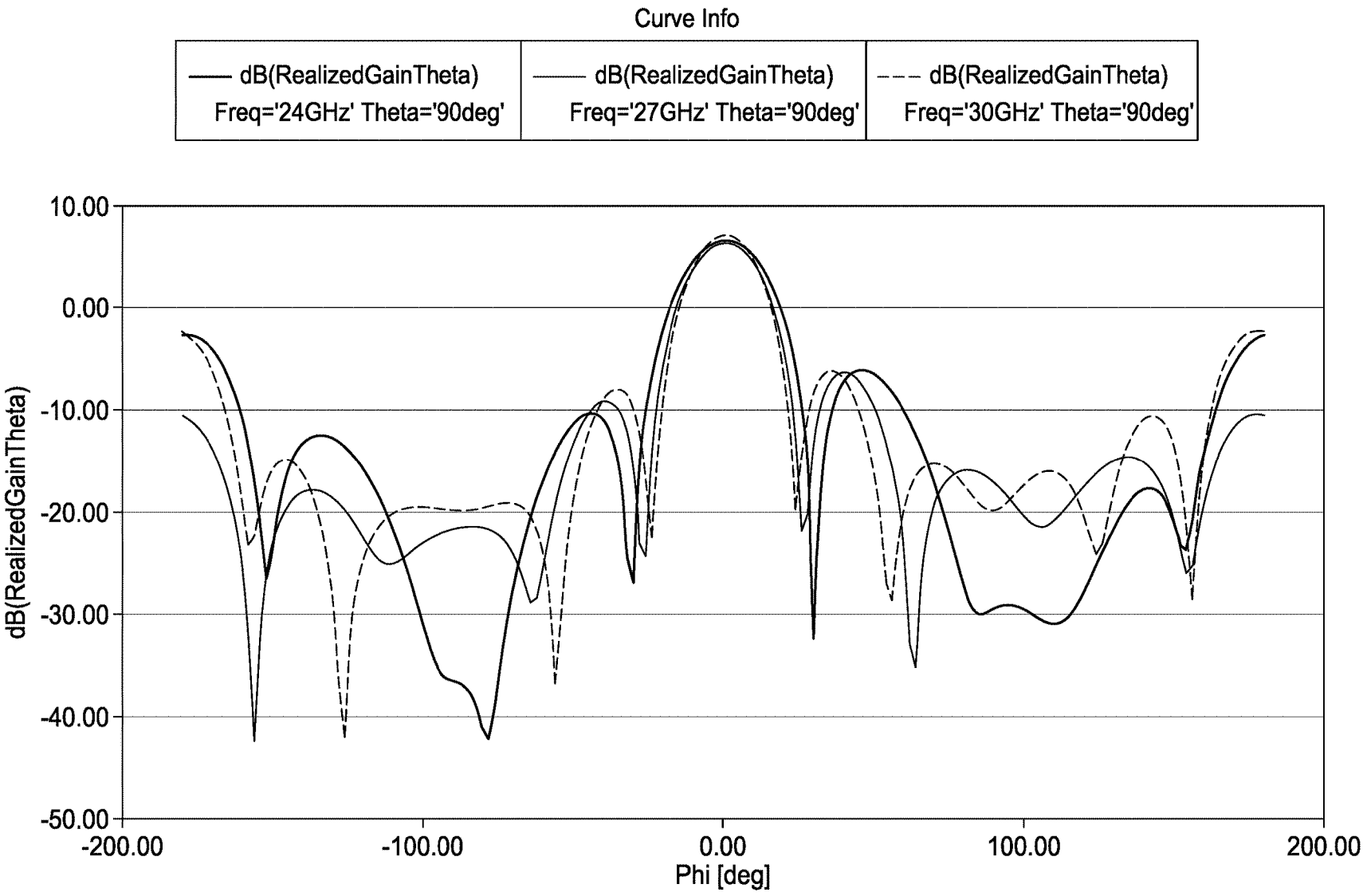
Figure 20B:
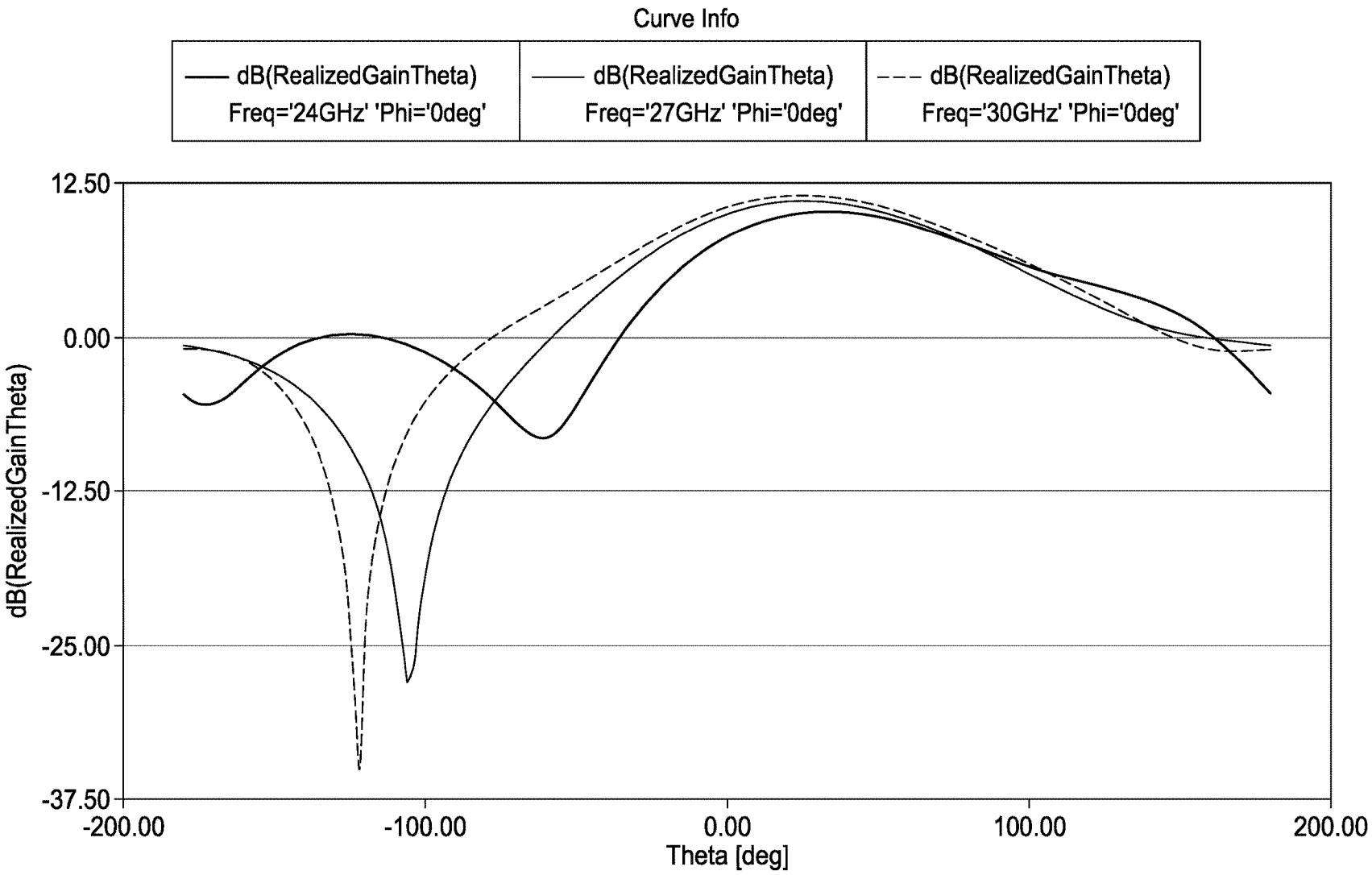

FIGS. 20A and 20B are radiation patterns for low-band of the vertically-polarized dual-band antenna elements in the xy-plane and the xz-plane, respectively.

Figure 21A:
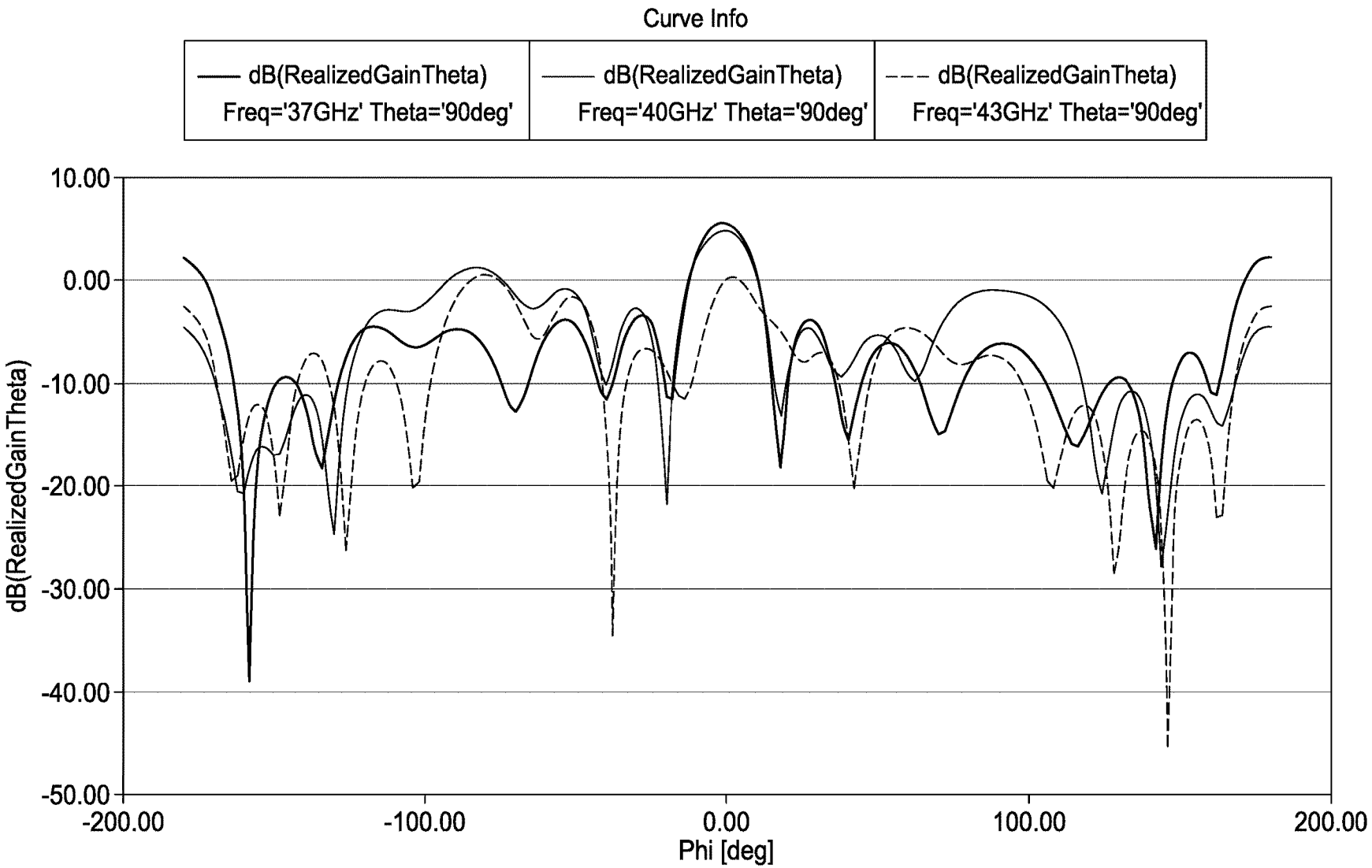
Figure 21B:
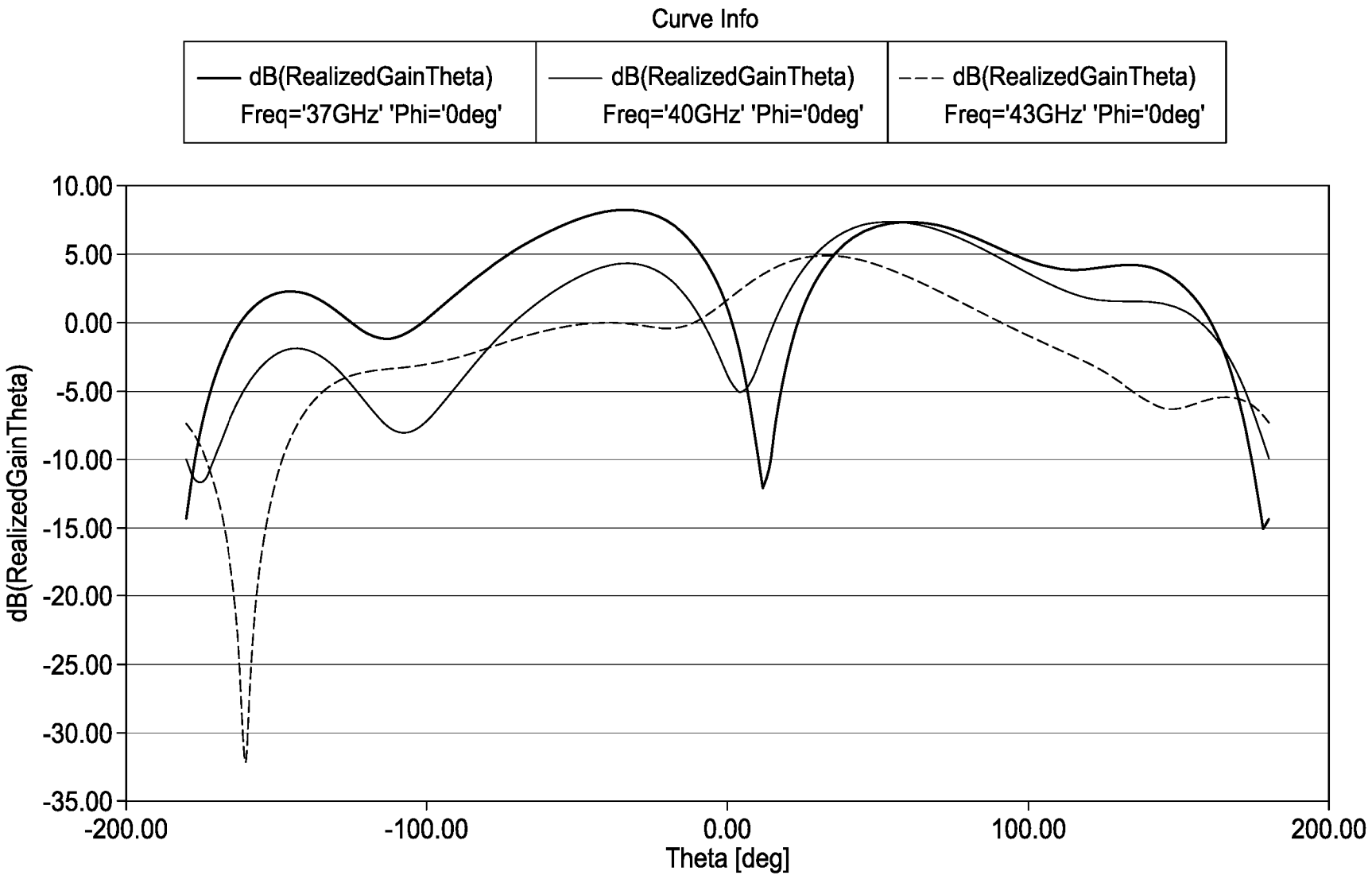

FIGS. 21A and 21B are radiation patterns for high-band of the vertically-polarized dual-band antenna elements in the xy-plane and the xz-plane, respectively.

Figure 22A:
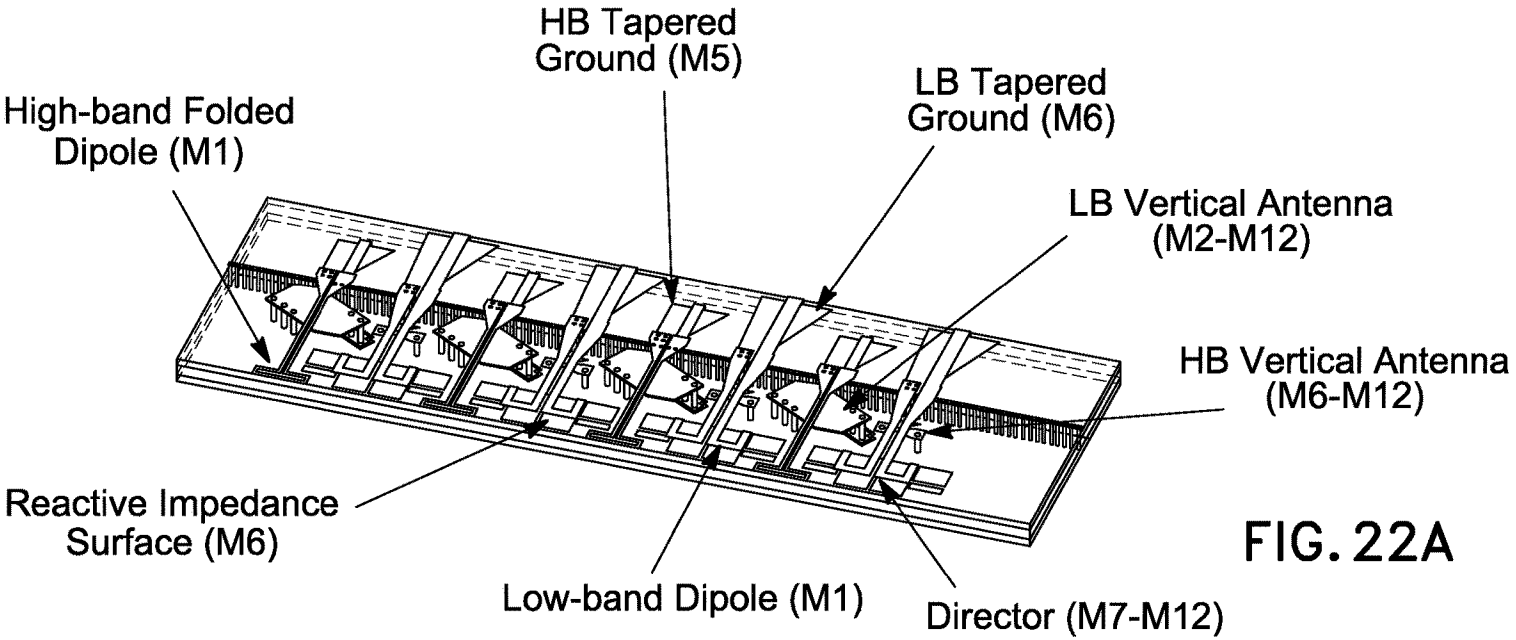
Figure 22B:
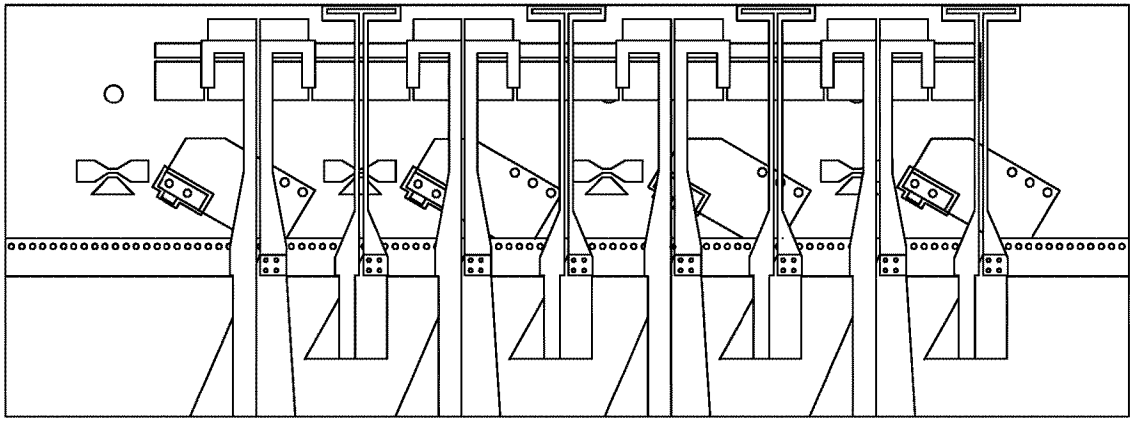

FIGS. 22A and 22B show the perspective and top view, respectively, of the combined dual-polarized dual-band antenna array.

Corresponding reference numerals indicate corresponding parts throughout the several views of the drawings.

DETAILED DESCRIPTION

Example embodiments will now be described more fully with reference to the accompanying drawings.

Figure 1:
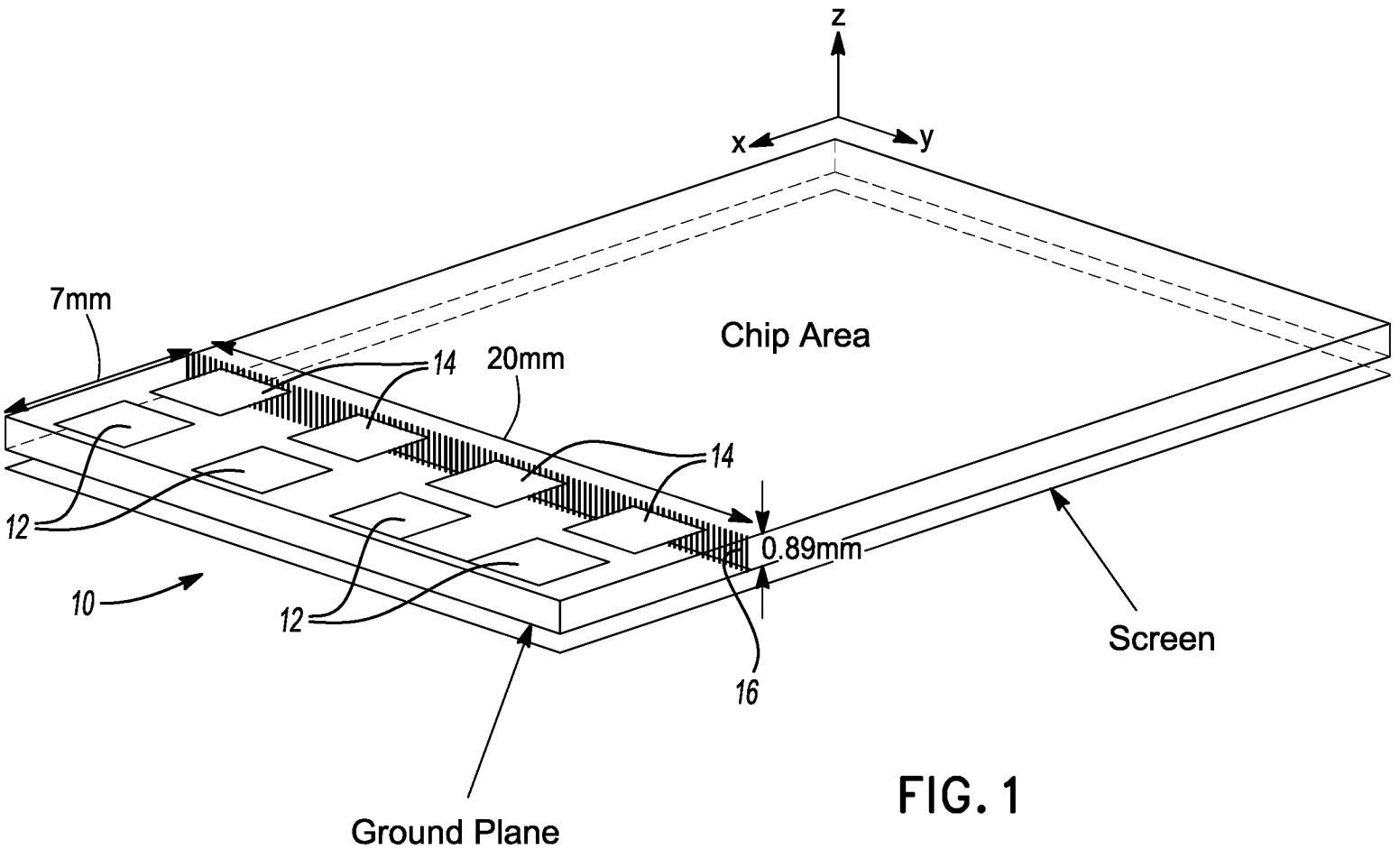
FIG. 1 is perspective view of an example embodiment of a wideband dual-polarized antenna on the multi-layer substrate.
Figure 2:
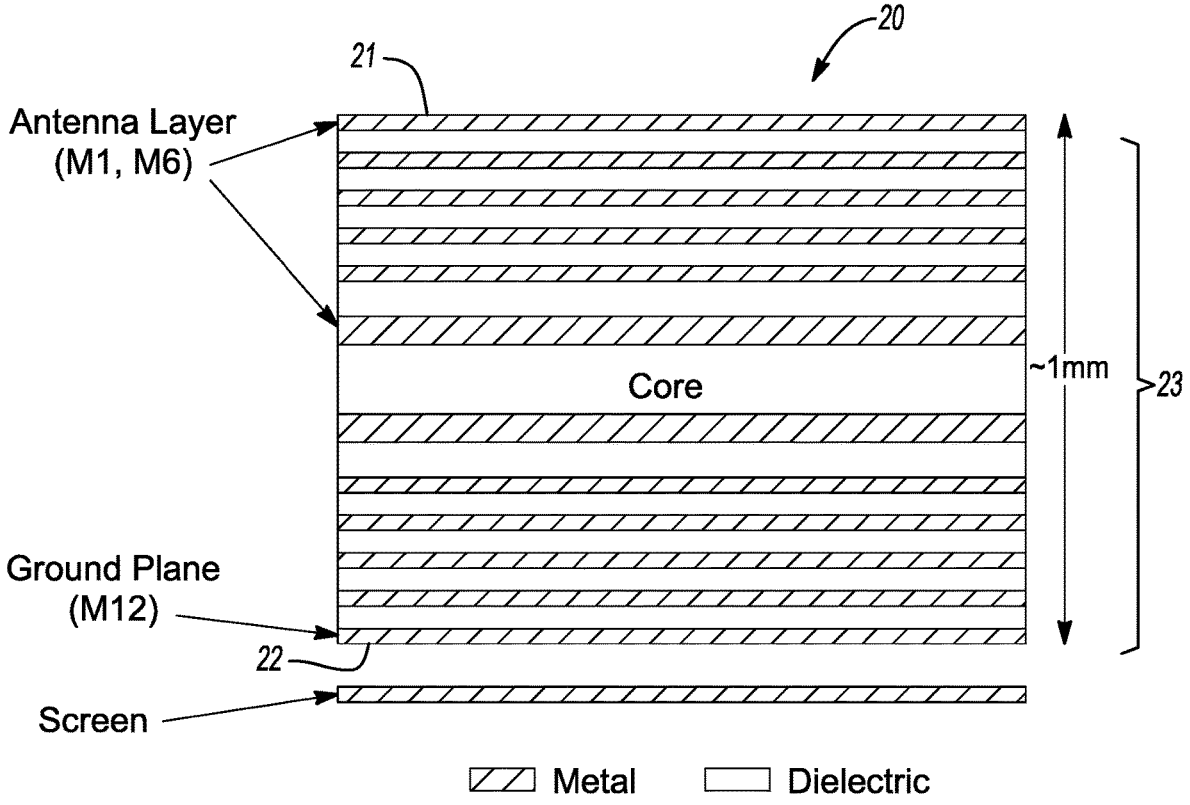
FIG. 2 is a partial cross-sectional view of the multi-layer substrate in which the wideband or dual-band dual-polarized antenna is fabricated.

FIGS. 1 and 2 depicts an example embodiment of a wideband dual-polarized antenna 10 for use in cell phones and other handheld devices. The antenna elements are integrated into a multi-layer structure 20 comprised of a top layer 21, a bottom layer 22 and intermediate layers 23 sandwiched in between the top layer 21 and the bottom layer 22. In one embodiment, the intermediate layers 23 alternate between metal layers and dielectric layers as seen in FIG. 2. The bottom layer is preferably the ground plane for the antenna. It is understood that there may be an arbitrary number of layers and that the thickness of the structure can vary.

The antenna 10 may include an array of horizontally-polarized antenna elements 12 and an array of vertically polarized antenna elements 14. Each antenna element in the array of horizontally-polarized antenna elements 12 is configured to receive and radiate horizontally polarized waves in a frequency band. Each antenna element in the array of vertically polarized antenna elements 14 is configured to receive and radiate vertically polarized waves in the same frequency band. In this example, the array of horizontally-polarized antenna elements 12 is disposed along the edge of the antenna structure; whereas, the array of vertically polarized antenna elements 14 is disposed between the array of horizontally-polarized antenna elements 12 and a via fence 16. It is understood that each array may include one or more antenna elements.

The via fence 16 is a row of metal pins embedded in the multi-layer structure 20. Each metal pin in the row of metal pins extends between the top layer 21 and the bottom layer 22. The row of metal pins is configured to separate the folded dipole antenna element and the folded monopole antenna element from other circuit components integrated onto the substrate. In the example embodiment, the row of metal pins extends between opposing edges of the multi-layer structure 20, thereby partitioning the substrate into an antenna area and a non-antenna area. It is envisioned that the via fence 16 may be configured in other ways to partition the antenna components from the other circuit components.

Figure 3:
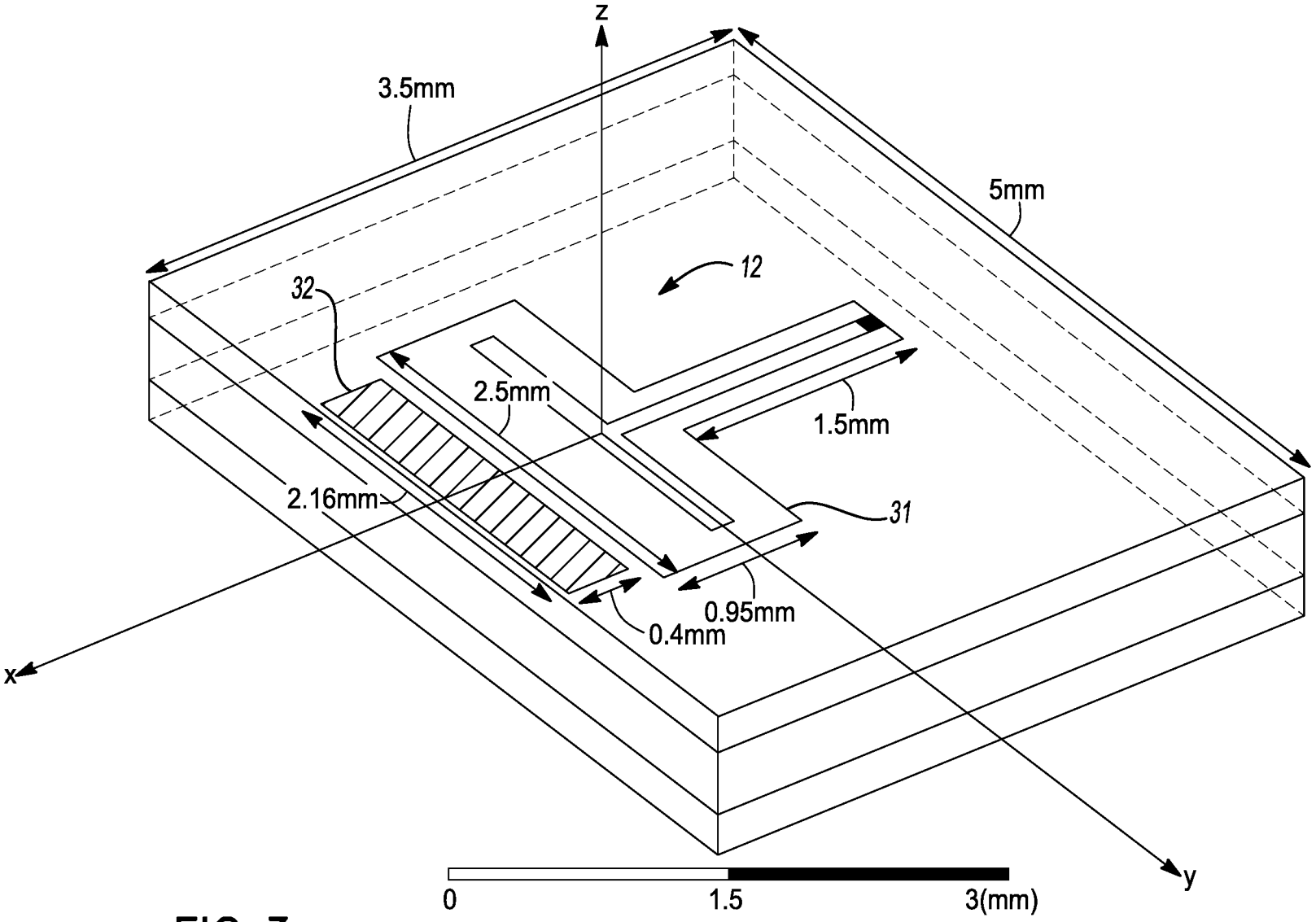
FIG. 3 is a perspective view of an antenna element in the array of horizontally polarized wideband antenna elements.

In the example embodiment, each antenna element 12 in the array of horizontally polarized antenna elements is further defined as folded dipole antenna element 31 as seen in FIG. 3. The folded dipole antenna element 31 is a planar conductor formed on the top layer of the multi-layer antenna structure. In this example, the folded dipole antenna element 31 is in the shape of letter "T" although other shapes are envisioned by this disclosure. A parasitic dipole element 32 is disposed proximate to each folded dipole antenna element 31. In this example, the parasitic dipole element has rectangular shape although other shapes are envisioned by this disclosure. FIG. 4 is a plot of the S-parameter for the horizontally polarized antenna elements 12 of the example embodiment. The radiation pattern for the horizontally polarized antenna elements 12 in the x-y plane is shown in FIGS. 5A and 5B. Other implementations for the horizontally polarized antenna elements are contemplated by this disclosure.

For vertical polarization, each antenna element 14 in the array of vertically polarized antenna elements is further defined as a folded monopole antenna element 61 as seen in FIGS. 6A and 6B. More specifically, the folded monopole antenna element 61 is a metal patch in the shape of a rectangle with opposing folded corners. The folded monopole antenna element 61 includes at least one feed pin 62 electrically coupled along an edge of the planar conductor and a plurality of shorting pins 63 electrically coupled between the planar conductor and the ground plane. In the example embodiment, the folded monopole antenna element 61 has five feed pins and five shorting pins although more or less number of pins is contemplated. The plurality of shorting pins 63 are spatially separated by $\lambda/2$ from the at least one feed pin, where $\lambda$ corresponds to wave in the operating frequency band. Other implementations for the vertically polarized antenna elements are contemplated by this disclosure.

The vertically polarized antenna elements 14 are formed in the upper layers of the multi-layer structure 21 but beneath the horizontally polarized antenna elements 12. In the example embodiment, the vertically polarized antenna elements 14 are disposed on sixth layer below the top layer of the multilayer structure. In this way, the horizontally polarized antenna elements 12 and the vertically polarized antenna elements 14 are monolithically integrated onto the substrate.

FIG. 7 is a plot of the S-parameter for the vertically polarized antenna elements 14 of the example embodiment. The radiation pattern for the vertically polarized antenna elements 14 is shown in FIGS. 8A and 8B. In the example embodiment, the antenna is configured to operate in the 28 GHz and 38 GHz frequency bands. It is readily understood that the design concepts set forth herein can be tailored for an antenna operating in other frequencies bands as well.

FIG. 9 depicts an example embodiment of a dual band, dual-polarized antenna 90 in accordance with another aspect of this disclosure. The dual-band, dual polarized antenna 90 is comprised generally of an array of horizontally-polarized antenna elements 92 and an array of vertically-polarized antenna elements 94. As described above, the antenna elements are integrated into a multi-layer structure. A via fence 95 separates the antenna 90 from the remainder of components integrated onto the chip. It is understood that each array may include one or more antenna elements.

In one embodiment, the array of horizontally-polarized antenna elements 92 are shown in FIG. 10A. Each antenna element in the array of horizontally-polarized antenna elements 92 includes a dipole antenna element 94 and a folded dipole antenna element 95. The dipole antenna element 94 is formed by a planar conductor in a top layer of the multi-layer structure. The dipole antenna element 94 is configured to receive and radiate horizontally polarized waves in a first frequency band. In this example, the dipole antenna element is formed by two u-shaped members arranged side-by-side although other shapes are envisioned by this disclosure. A reactive impedance surface 96 is preferably disposed underneath the dipole antenna element in one of the intermediate layers of the multi-layer structure. In the example embodiment, the reactive impedance surface 96 is disposed on the sixth layer below the top layer of the multilayer structure.

The folded dipole antenna element 95 is disposed adjacent to the dipole antenna element 94 and is formed by a planar conductor in the top layer of the multi-layer structure. The folded dipole antenna element 95 is also configured to receive and radiate horizontally polarized waves but in a second frequency band, where the lower bound of the second frequency band is higher than the upper bound of the first frequency band. In this example, folded dipole antenna element is rectangular with a t-shaped slot formed therein although other shapes are contemplated by this disclosure. While particular shapes are shown for the antenna elements, different shapes are contemplated by this disclosure.

FIG. 11 is a plot of the S-parameter for the horizontally-polarized antenna elements 92. In the example embodiment, the antenna is configured to operate in a low frequency band of 24-30 GHz and a higher frequency band of 37-43 GHz. For the lower band, radiation patterns for the horizontally-polarized antenna elements 92 in the xy-plane and the xz-plane are shown in FIGS. 12A and 12B, respectively. For the higher band, radiation patterns for the horizontally-polarized antenna elements 92 in the xy-plane and the xz-plane are shown in FIGS. 13A and 13B, respectively.

Each element of the dual-band antenna array is connected to individual coherent transceivers whose input/output, at an intermediate frequency or baseband, can be phase shifted in such a way to form a beam at any desired direction. FIG. 14 is beam-steered radiation pattern for low-band horizontally-polarized dual-band antenna elements in the xy-plane; whereas, FIG. 15 is beam-steered radiation pattern for high-band horizontally-polarized dual-band antenna element in the xy-plane.

FIG. 16 illustrates an example of a built-in balun used to connect a microstrip line and match it to a coplanar strip transmission line needed to feed the horizontally-polarized antenna elements. Because the antenna elements use a balanced feed, a tapered ground plane is used to transition from the microstrip line to the feed for the antenna elements. Each element in the array of horizontally-polarized antenna elements 92 is electrically coupled to a balun as shown in FIG. 17. The folded dipole antenna elements 95 align with an edge of the substrate; whereas, the dipole antenna elements 94 are offset from the folded dipole antenna elements 95 in an inward direction from the edge of the substrate. As noted above, a reactive impedance surface 96 is preferably disposed underneath the dipole antenna elements 94 but not the top portion of the folded dipole antenna elements 95. It is readily understood that the design concepts set forth herein can be tailored for an antenna operating in other frequencies bands as well.

FIG. 18 depicts an example embodiment for an antenna element in the array of vertically-polarized antenna elements 94. Each antenna element in the array of vertically-polarized antenna elements 94 includes a low-band folded monopole antenna element 182 and a high-band folded monopole antenna element 184. The low-band folded monopole antenna element 182 is formed by a planar conductor in one of the upper layers of the multi-layer structure. The low-band monopole antenna element 182 is configured to receive and radiate vertically polarized waves in the first frequency band. The low-band folded monopole antenna element and the high-band folded monopole antenna element are monolithically integrated onto the substrate.

In the example embodiment, the low-band monopole antenna element 182 is the shape of a rectangular patch with folded opposing corners. The low-band monopole antenna element 182 includes at least one feed pin electrically coupled along an edge of the planar conductor and a plurality of shorting pins electrically coupled between the planar conductor and the ground plane. The feed pins are preferably arranged on opposing side of the planar conductor from the shorting pins. More specifically, the shorting pins are spatially separated by $\lambda/2$ from the feed pin, where $\lambda$ corresponds to a wave in the first frequency band. Other shapes for the low-band monopole antenna element are contemplated by this disclosure.

In the example embodiment, the high-band monopole antenna element 184 is comprised of two patches: a bowtie shaped patch and a trapezoid shaped patch. The trapezoid shaped patch is capacitively coupled to the bowtie patch with its narrow end positioned proximate the middle of the bowtie to increase bandwidth of the high-band monopole antenna element. The bowtie shaped patch has a length of approximately $\lambda/2$ with a feeding pin at one longitudinal end and a shorting pin at the other longitudinal end. Other shapes for the high-band monopole antenna element are contemplated by this disclosure.

FIG. 19 is a plot of the S-parameter for the vertically-polarized antenna elements 98 in the example embodiment. As noted above, the antenna is configured to operate in a low frequency band of 24-30 GHz and a higher frequency band of 37-43 GHz. For the lower band, radiation patterns for the vertically-polarized antenna elements 98 in the xy-plane and the xz-plane are shown in FIGS. 20A and 20B, respectively. For the higher band, radiation patterns for the horizontally-polarized antenna elements 98 in the xy-plane and the xz-plane are shown in FIGS. 21A and 21B, respectively.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A wideband dual-polarized antenna, comprising:

a top layer;

a ground plane;

intermediate layers sandwiched between the top layer and the ground plane and forming a multi-layer structure;

a folded dipole antenna element formed by a planar conductor residing in the top layer and disposed along an edge of the ground plane, where the folded dipole antenna element is configured to receive and radiate horizontally polarized waves in a frequency band and in an endfire direction parallel to plane of the ground plane, such that the edge of the ground plane reflects the horizontally polarized wave in the endfire; and a folded monopole antenna element formed by a planar conductor residing in one of the intermediate layers and configured to receive and radiate vertically polarized waves in the frequency band and in the endfire direction parallel to plane of the ground plane, where the folded dipole antenna element and the folded monopole antenna element are monolithically integrated onto the ground plane; and a row of metal pins embedded in the multi-layer structure and configured to separate the folded monopole antenna element from other circuit components integrated onto the substrate, where each metal pin in the row of metal pins extends between the top layer and the ground plane and the row of metal pins reflect the vertically polarized wave in the endfire direction.

2. The wideband dual-polarized antenna of claim 1 wherein the folded monopole antenna element is shape of a rectangle with opposing folded corners.

3. The wideband dual-polarized antenna of claim 1 wherein the folded monopole antenna element further includes at least one feed pin electrically coupled along an edge of the planar conductor and a plurality of shorting pins electrically coupled between the planar conductor and the ground plane.

4. The wideband dual-polarized antenna of claim 3 wherein the plurality of shorting pins are spatially separated by $\lambda/2$ from the at least one feed pin, where $\lambda$ corresponds to wave in the frequency band.

5. The wideband dual-polarized antenna of claim 1 further includes a parasitic dipole element proximate the folded dipole antenna element.

6. The wideband dual-polarized antenna of claim 1 wherein the lower bound of the frequency band is greater than 24 GHz.

7. The wideband dual-polarized antenna of claim 1 wherein the frequency band covers 24-32 GHz and 36-43 GHz.

8. A dual-band dual-polarized antenna, comprising:

a dipole antenna element formed by a planar conductor on a substrate and configured to receive and radiate horizontally polarized waves in a first frequency band;

a folded dipole antenna element disposed adjacent to the dipole antenna element and configured to receive and radiate horizontally polarized waves in a second frequency band, where lower bound of the second frequency band is higher than upper bound of the first frequency band;

a low-band folded monopole antenna element formed by a planar conductor on the substrate and configured to receive and radiate vertically polarized waves in the first frequency band; and a high-band folded monopole antenna element is adjacent to the low-band folded monopole antenna element and configured to receive and radiate vertically polarized waves in the second frequency band, where the dipole antenna element, the folded dipole antenna element, the low-band folded monopole antenna element and the high-band folded monopole antenna element are monolithically integrated onto the substrate.

9. The dual-band dual-polarized antenna of claim 8 is a multi-layer structure comprised of a top layer, a bottom layer and intermediate layers sandwiched therebetween, such that the dipole antenna element resides in the top layer, the folded dipole antenna element resides in one of the intermediate layers and the bottom layer is a ground plane.

10. The dual-band dual-polarized antenna of claim 9 further comprises a reactive impedance surface disposed directly underneath the dipole antenna element in one of the intermediate layers of the multi-layer structure.

11. The dual-band dual-polarized antenna of claim 10 further includes a row of metal pins embedded in the multi-layer structure and configured to separate the folded dipole antenna element and the folded monopole antenna element from other circuit components integrated onto the substrate, where each metal pin in the row of metal pins extends between the top layer and the bottom layer.

12. The dual-band dual-polarized antenna of claim 9, wherein the low-band folded monopole antenna element is shape of a rectangle patch.

13. The dual-band dual-polarized antenna of claim 12 wherein the low-band folded monopole antenna element further includes at least one feed pin electrically coupled along an edge of the planar conductor and a plurality of shorting pins electrically coupled between the planar conductor and the ground plane.

14. The dual-band dual-polarized antenna of claim 13 wherein the plurality of shorting pins are spatially separated by $\lambda/2$ from the at least one feed pin, where $\lambda$ corresponds to wave in the first and second frequency bands.

15. The dual-band dual-polarized antenna of claim 9 wherein the high-band folded monopole antenna element includes a bowtie shaped patch capacitively coupled to a trapezoid shaped patch, where trapezoid patch is arranged with its narrow end proximate to middle of the bowtie.

16. The dual-band dual-polarized antenna of claim 15 wherein the bowtie shaped patch has a length of $\lambda/2$ with a feed pin at one end of a longitudinal axis and a shorting pin at other end of the longitudinal axis.

17. The dual-band dual-polarized antenna of claim 8 wherein the lower bound of the first frequency band is greater than 24 GHz.

18. The dual-band dual-polarized antenna of claim 8 wherein the first frequency band is 24-30 GHz and the second frequency band is 37-43 GHz.

* * * * *